US006794633B2

(12) United States Patent
Iwasaki

(10) Patent No.: US 6,794,633 B2
(45) Date of Patent: Sep. 21, 2004

(54) SHEET DETECTING DEVICE AND IMAGE FORMING APPARATUS

(75) Inventor: Hisanori Iwasaki, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 121 days.

(21) Appl. No.: 10/200,772

(22) Filed: Jul. 24, 2002

(65) Prior Publication Data

US 2003/0025090 A1 Feb. 6, 2003

(30) Foreign Application Priority Data

Jul. 26, 2001 (JP) ..... 2001-226575
Jul. 27, 2001 (JP) ..... 2001-228499
Jul. 27, 2001 (JP) ..... 2001-228641

(51) Int. Cl.[7] ..... G06M 7/00
(52) U.S. Cl. ..... 250/221; 250/559.4; 271/265.01
(58) Field of Search ..... 250/221, 223 R, 250/559.36, 559.4; 226/45; 209/574; 271/265.01, 265.02, 153

(56) References Cited

U.S. PATENT DOCUMENTS 5,075,543 A * 12/1991 Courtney ..... 250/223 R
5,260,564 A * 11/1993 Bruggeling et al. .... 250/223 R
5,585,645 A * 12/1996 Goto ..... 250/559.12

FOREIGN PATENT DOCUMENTS

| | | |
|---|---|---|
| EP | 0 058 285 | 8/1982 |
| FR | 2 588 385 | 4/1987 |
| JP | 59-131188 | 7/1984 |
| JP | 6-222156 | 8/1994 |
| JP | 8-119493 | 5/1996 |
| JP | 11-208935 | 8/1999 |

* cited by examiner

*Primary Examiner*—Stephone B. Allen
*Assistant Examiner*—Patrick J. Lee
(74) *Attorney, Agent, or Firm*—Fitzpatrick, Cella, Harper & Scinto

(57) ABSTRACT

A sheet detecting device has a light emitting and receiving unit having a light emitting element for emitting detection light and a light receiving element for receiving the detection light, and a reflecting member for reflecting the detection light emitted from the light emitting element and making the reflected light incident to the light receiving element, and is constructed in a configuration wherein the light emitting and receiving unit and the reflecting member are placed with a sheet transport path between. The sheet detecting device is configured to detect a sheet on the basis of interruption of the detection light by the sheet transported through the sheet transport path. The sheet detecting device has an emission slit which restricts the detection light emitted from the light emitting element and which is arranged so as to be longitudinal along a sheet transport direction, and a reception slit which restricts the detection light incident to the light receiving element and which is arranged so as to be longitudinal along a direction intersecting with the sheet transport direction.

5 Claims, 16 Drawing Sheets

DIRECTIONAL PATTERN

DIRECTIONAL SENSITIVITY PATTERN

SHEET DETECTING DEVICE AND IMAGE FORMING APPARATUS

BACKGROUND OF THE INVENTION

1. Field of the Invention

The present invention relates to a sheet detecting device and an image forming apparatus.

2. Description of Related Art

The conventional image forming apparatus such as a copying machine, a facsimile machine and a printer for dealing with sheets are generally constructed in structure provided with a sheet transporting device for feeding (or transporting) each sheet to a predetermined position in synchronism with a feed signal from the main body of the apparatus.

In the sheet transporting device of this type, it is necessary to separate and feed sheets one by one from a stack of sheets stacked on a tray or in a cassette and transport each sheet to a predetermined position at predetermined timing synchronized with formation of an image, with a high degree of accuracy. For this reason, a sheet detecting device is disposed on the sheet transporting device to detect the position of the leading edge or the trailing edge of each sheet.

The sheet detecting devices are generally classified into a contact sensor type and a non-contact sensor type.

The contact sensors are detecting devices frequently used heretofore. For example, there are the known contact sensors of structure in which an inclinable lever is arranged to project in a sheet transport path and in which, with a transporting sheet coming into contact with one end of the lever, an inclination of the lever is detected by a transmissive photosensor provided at the other end.

As the recent increase in operation speed of printers raised the sheet transportation speed, the conventional contact sensors came to encounter a problem of damaging the leading edge of the sheet, however. There are thus increasing tendencies to equip the high-speed machines with an optical sensor for optically and directly reading the presence/absence of a sheet in a non-contact manner.

The optical sensor is also used for the purpose of discriminating a type of each sheet. For example, in the case of a color printer being configured to form a color image through multi-layer transfer steps of toner materials of multiple colors, in order to effect print on a light transmissive sheet for OHP, it is necessary to perform a control of switching a fixing speed to a lower speed enough to increase optical transmittance by sufficiently fusing the toner, and the optical sensor is thus arranged to detect whether the sheet is a light transmissive sheet such as an OHP sheet.

A conventional optical sheet detecting device used in the image forming apparatus will be described below with reference to FIG. 15.

The sheet transporting device of FIG. 15 is provided with a stepping motor (not shown) which drives a sheet feed load, described hereinafter, at a predetermined speed in accordance with a command from a control unit (not shown); a semicircular roller 201 which separates and feeds a sheet from a stack of sheets in a cassette 214 on the basis of a control of releasing a latch by a solenoid (not shown) and mechanically rotating the roller through one revolution; transporting rollers 202 disposed downstream of the semicircular roller 201; registration rollers 204 which are switchable between a halt and rotation by an electromagnetic clutch; a sheet presence/absence detecting sensor 203 of the contact type as an ante-registration sensor disposed immediately before the registration rollers 204; and a leading edge sensor 205 as an optical sheet presence/absence detecting means disposed downstream of the registration rollers.

The main body section as an image forming means of the image forming apparatus is provided with a photosensitive drum 211 as an image bearing member; a scanner 210 which forms an electrostatic latent image on the photosensitive drum 211; a developing device 209 which develops the electrostatic latent image with toner materials of respective colors of C, M, Y, and K; a transfer drum 207 which rotates in a state in which a sheet transported by the sheet transporting device is wound around and attached onto the transfer drum 207, and which transfers toner images of the respective colors formed on the photosensitive drum 211, onto the sheet; a stripping claw 212 which strips the sheet with the toner images transferred thereon, from the transfer drum 207; and a fixing device 213 which thermally fixes the transferred toner images on the sheet. A gripper 208 for gripping the leading edge of the sheet is provided on the transfer drum 207 and a gripper position sensor 206, which detects arrival of the gripper 208 at a position equivalent to the sheet feed position of the leading edge sensor 205, is provided in the vicinity of the transfer drum 207.

A configuration of the control unit, which controls the hardware structure as described above, will be described. When a print signal is issued, the control unit rotates the semicircular roller 201 through one revolution to feed a sheet at a predetermined speed, and also rotates the transfer drum 207.

The sheet transported by the transporting rollers 202 comes into abutment against a nip between the registration rollers 204 kept in a halt state to form a loop of a certain size, thereby implementing skew-feed correction. The registration rollers 204 then start to be rotated at a certain time after detection of the leading edge of the sheet at the ante-registration sensor 203 to lead the skew-corrected sheet in. When the leading edge sensor 205 detects the leading edge of the sheet thereafter, the registration rollers 204 are again brought into a halt state to stand by.

When the gripper sensor 206 detects arrival of the gripper on the transfer drum 207, the control unit restarts the stepping motor and controls the registration rollers 204 so that the sheet is transported at a feed speed relatively faster than the speed of the transfer drum 207 for a certain period of time and thereafter the feed speed is switched back to the same speed as the speed of the transfer drum 207.

This makes it feasible to perform such synchronous control as to close the gripper 208 while the sheet butts by a predetermined amount against the gripper 208 opening approximately 30° relative to the surface of the transfer drum 207, and always feed the sheet stably to the gripper position as a leading edge position during the transferring operation.

The following will describe a control operation performed in feeding an OHP sheet by the sheet feed control and the optical sheet detecting device.

When an OHP sheet is fed up to the leading edge sensor 205 through the sheet feed control, the leading edge sensor 205 detects a light shield portion preliminarily printed in the width of 5 mm downstream from the leading edge on the sheet, whereupon the stepping motor is halted to stand by. When the gripper sensor 206 detects the gripper, the OHP sheet is refed. Thereafter, the leading edge sensor 205 detects a transmissive portion spaced by 20 mm and subsequent distances away from and downstream of the leading edge of the OHP sheet (or detects transmission of light) to make a judgment as an OHP sheet. Then toner images are transferred, and thereafter the control unit performs such control as to decrease the driving speed of the fixing device 213 to one third of the normal speed at the time of stripping and discharging the sheet.

A configuration of the leading edge sensor 205 will be described below referring to FIGS. 16A and 16B.

In FIGS. 16A and 16B the leading edge sensor 205 is a transmissive photosensor in which a reflecting member 126 is disposed on one side of the sheet transport path 121 and a light emitting and receiving unit 120 including a light emitting element 122 and a light receiving element 123 is disposed on the other side.

When no sheet S is present as shown in FIG. 16A, light L emitted from the light emitting element 122 travels through a slit 124 provided in a light shield cover to be reflected by the reflecting member 126, and the reflected light again travels through a slit 125 provided in the light shield cover to reach the light receiving element 123. When a sheet S is present on the other hand as shown in FIG. 16B, the light L emitted from the light emitting element 122 is shut off by the sheet S so as not to reach the light receiving element 123.

Namely, in the case of the sheet such as paper or the like, the absence of the sheet is determined with detection of light at the light receiving element 123, while the presence of the sheet is determined without detection of light. In the case of the transmissive sheet such as the OHP sheet or the like, whether the sheet is a transmissive sheet is determined based on the operation in which the light is once shut off by the light shield portion printed on the sheet and the light receiving element 123 detects the light after transportation by the predetermined amount, as described above.

The transmissive photosensor of the non-contact type as described is required to increase the S/N ratio between reflected light (signal) back from the reflecting member and reflected light (noise) back from the sheet surface, thereby raising the detection accuracy of the sheet. The slits 124, 125 are provided for the purpose of restricting the widths of the irradiated light and reflected light to restrain the reflected light back from the sheet surface from entering the light receiving element 123, thereby decreasing the noise.

However, the problem as described below was encountered in the related art case as described above.

Because of the configuration wherein the reflecting member 126 and the light emitting and receiving unit 120 are disposed on the both sides of the sheet transport path 121, a relative positional deviation is apt to occur between the two members in installation of the members. With occurrence of the positional deviation, the quantity of reflected light from the reflecting member 126 will be greatly affected.

For example, where a parallel positional deviation occurs between the reflecting member 126 and the light emitting and receiving unit 120, as shown in FIG. 17A, the spacing is expanded between the optical path of the irradiated light from the light emitting element 122 and the optical path of the reflected light back from the reflecting member 126 (the spacing is narrowed in the case of the deviation opposite to that in the same drawing), so as to cause a deviation between the optical path of the reflected light and the position of the slit 125 of the light receiving element 123, thereby significantly decreasing the quantity of reflected light detected by the light receiving element 123. When the reflecting member 126 and the light emitting and receiving unit 120 are installed with some rotational deviation, as shown in FIG. 17B, a problem similar to the above problem also occurs because of change in the spacing between the optical paths.

Since there is little change in the quantity of the reflected light back from the sheet surface in these cases on the other hand, the S/N ratio is lowered as a result to increase the risk of causing a detection error of the sheet.

In order to solve the above problem, it is conceivable that some margin is given to the slit widths so as to make allowance for some positional deviation. However, increase in the widths of the slits 124', 125', as shown in FIG. 18, increases the quantity of the reflected light back from the sheet surface in turn, also resulting in decrease of the S/N ratio. In addition, since the increase of the slit widths results in requiring a considerable time for the sheet S to cover the slits, variation occurs in the timing of detecting the presence of the sheet, posing another problem of degradation of the position detection accuracy of the sheet S.

SUMMARY OF THE INVENTION

The present invention has been accomplished in order to solve the above-stated problems in the related art, and an object of the invention is to provide a sheet detecting device that permits stable detection with the S/N ratio being maintained high even with the relative positional deviation between the reflecting member and the light emitting and receiving unit and that permits improvement in the position detection accuracy in the transport direction of the sheet, and to provide an image forming apparatus including the sheet detecting device.

In order to achieve the above object, a sheet detecting device according to the present invention is a sheet detecting device comprising a light emitting and receiving unit having a light emitting element for emitting detection light and a light receiving element for receiving the detection light, and a reflecting member for reflecting the detection light emitted from the light emitting element and make the detection light incident to the light receiving element, in which the light emitting and receiving unit and the reflecting member are placed with a sheet transport path between them, thereby a sheet is detected on the basis of interruption of the detection light by the sheet transported in the sheet transport path, the sheet detecting device comprising an emission slit which restricts (or stops down) the detection light emitted from the light emitting element and which is arranged so as to be longitudinal along a sheet transport direction; and a reception slit which restricts (or stops down) the detection light incident to the light receiving element and which is arranged so as to be longitudinal along a direction perpendicular to the sheet transport direction.

In a preferred configuration, the light emitting element and the light receiving element are placed so that center axes of respective optical paths thereof are approximately parallel to each other, and the reflecting member reflects the detection light approximately normally incident thereto from the light emitting element, approximately in parallel with the incident light to make the detection light incident approximately normally to the light receiving element.

In this configuration, the reflecting member is preferably constructed of an optical prism.

In another preferred configuration, a longitudinal width of the reception slit is set approximately two or more times greater than a transverse width of the emission slit.

In another preferred configuration, an area of the emission slit is set greater than an area of the reception slit.

An image forming apparatus according to the present invention comprises the sheet detecting device, and image forming means which forms an image on a sheet through control of the sheet by the sheet detecting device.

Since the present invention is based on the configuration wherein the emission slit for restricting the detection light emitted from the light emitting element is arranged so as to be longitudinal along the sheet transport direction and wherein the reception slit for restricting the detection light incident to the light receiving element is arranged so as to be longitudinal along the direction perpendicular to the sheet transport direction, it permits the stable detection with the S/N ratio being maintained high even with the relative positional deviation between the reflecting member and the light emitting and receiving unit and also permits the improvement in the position detection accuracy in the transport direction of the sheet.

BRIEF DESCRIPTION OF THE DRAWINGS

FIGS. 11A, 11B, and 11C are illustrations for explaining the operation of a transported sheet detecting device of a first embodiment, wherein FIG. 11A is a sectional view along the direction cross the sheet transport direction, FIG. 11B is a sectional view along the direction cross the sheet transport direction to show a sheet detecting state, and FIG. 11C is a sectional view along the sheet transport direction to show a sheet detecting state;

FIGS. 13A, 13B, and 13C are illustrations for explaining the operation of a transported sheet detecting device of a second embodiment, wherein FIG. 13A is a sectional view along the direction cross the sheet transport direction, FIG. 13B is a sectional view along the direction cross the sheet transport direction to show a sheet detecting state, and FIG. 13C is a sectional view along the sheet transport direction to show a sheet detecting state;

FIGS. 14A, 14B, and 14C are illustrations for explaining the operation of a transported sheet detecting device of a third embodiment, wherein FIG. 14A is a sectional view along the direction cross the sheet transport direction, FIG. 14B is a sectional view along the direction cross the sheet transport direction to show a sheet detecting state, and FIG. 14C is a sectional view along the sheet transport direction to show a sheet detecting state;

DESCRIPTION OF THE PREFERRED EMBODIMENTS

The preferred embodiments of the present invention will be illustratively described below in detail with reference to the drawings. The sheet detecting device is suitably applicable to the sheet transporting device for transporting (or feeding) a sheet in the image forming apparatus such as the printers, copying machines, facsimile machines, and so on.

It is noted that the dimensions, materials, shapes, relative arrangement, etc. of the components described in the following embodiments are by no means intended to limit the scope of the invention to only those unless specifically described otherwise.

Figure 1:
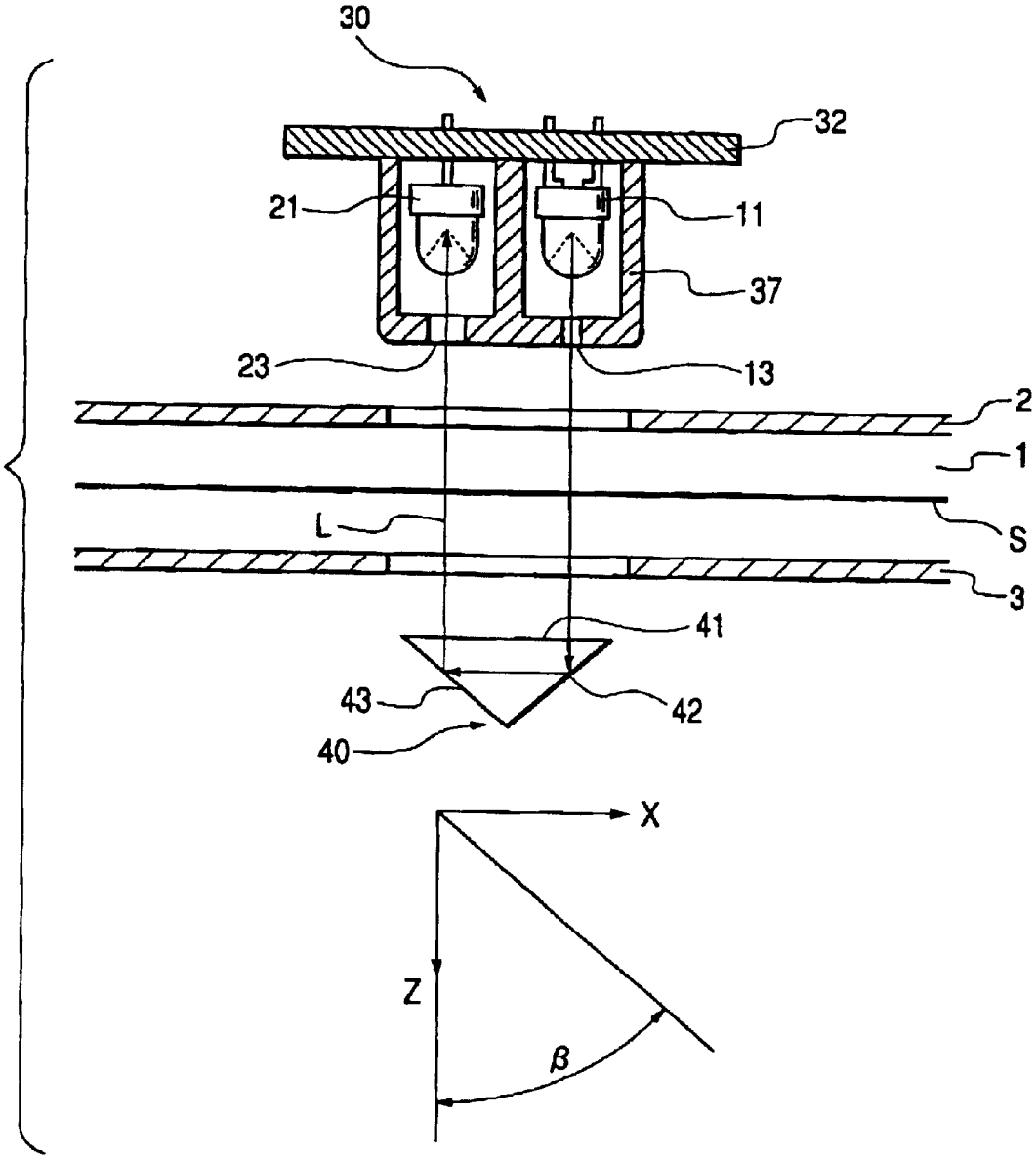
FIG. 1 is a schematic sectional view showing a configuration of a sheet detecting device according to an embodiment of the present invention.
Figure 2:
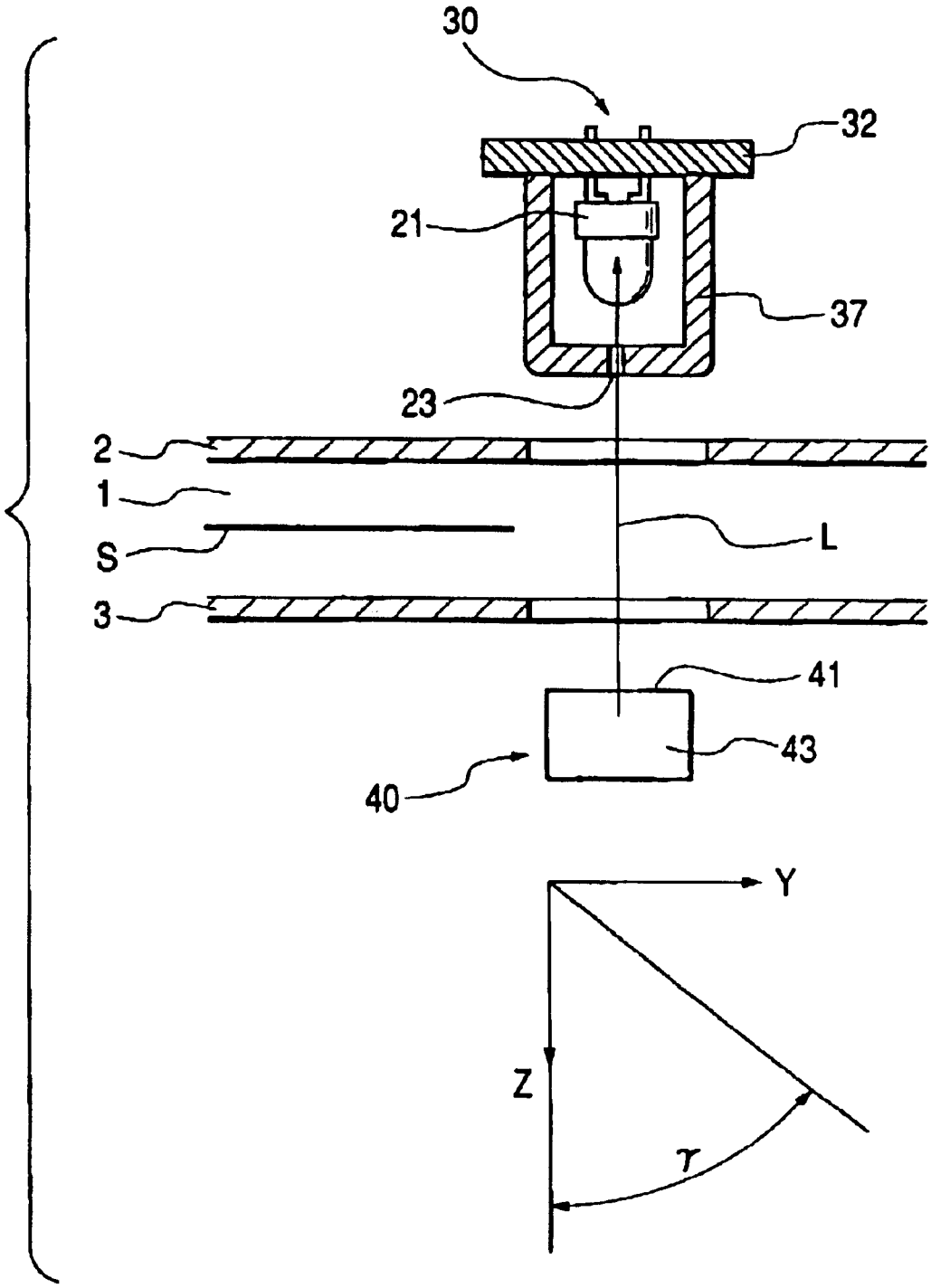
FIG. 2 is a schematic sectional view showing the configuration of the sheet detecting device according to the embodiment of the present invention.

FIGS. 1 and 2 are schematic sectional views showing the configuration of the sheet detecting device according to an embodiment of the present invention. FIG. 1 is a schematic sectional view from the sheet transport direction and FIG. 2 a schematic sectional view from the direction perpendicular to the sheet transport direction (i.e., from the right in FIG. 1).

The sheet transport path 1 is a space provided for transporting a sheet S between a sheet guide 2 and a sheet guide 3, through which the sheet S is transported by a transporting roller (not shown). The sheet S as an object to be detected, having been transported, is detected by the sheet detecting device disposed in the middle of the sheet transport path 1. Control of transportation, e.g., transport timing of the sheet S, is performed based on the result of the detection.

The sheet detecting device is generally comprised of a light emitting and receiving unit 30 having a light emitting element 11 and a light receiving element 21, and a reflecting member 40 configured to reflect detection light emitted from the light emitting element 11 and make the detection light incident to the light receiving element 21. The light emitting and receiving unit 30 and the reflecting member 40 are placed at respective positions so as to face each other with the sheet transport path 1 between.

The light emitting and receiving unit 30 is comprised of the light emitting element 11 for emitting the detection light, the light receiving element 21 for receiving the detection light, a printed circuit board 32 on which the light emitting element 11 and the light receiving element 21 are mounted, and a cover 37 covering these elements.

Figure 3A:
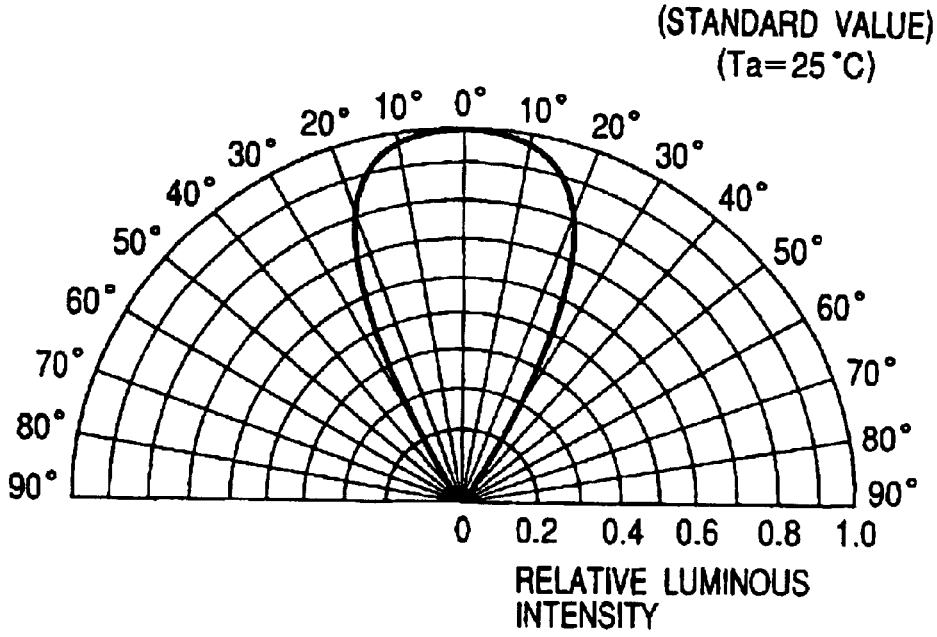
FIGS. 3A and 3B are diagrams showing a directional pattern of the light emitting element and a directional sensitivity pattern of the light receiving element, respectively.

The light emitting element 11 can be constructed, for example, of an infrared emitting diode or the like. The light emitted from the light emitting element 11 is not perfect parallel light, but light with some spread. FIG. 3A shows a directional pattern of an ordinary light emitting element, in which the solid line part of fan shape indicates relative luminous intensities in angles with respect to the center axis of the element. As is apparent from FIG. 3A, the light emitting element 11 emits the detection light with a spread of approximately 20° to 30°.

Figure 3B:
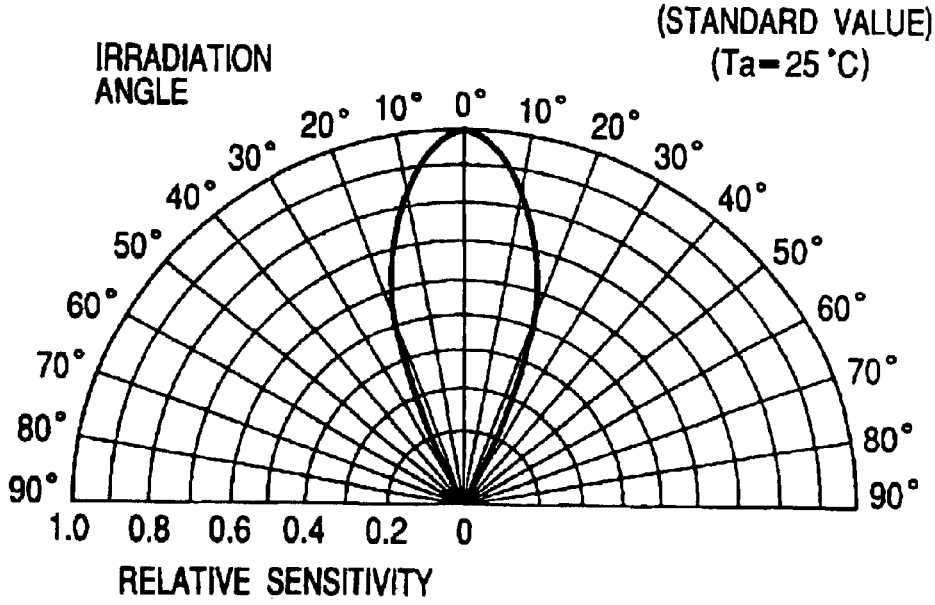

The light receiving element 21 can be constructed, for example, of a phototransistor for photoelectrically transferring received light into a photocurrent, or the like. The light receiving element 21 does not react to only light incident in parallel, but also reacts to light from lateral directions to some extent. FIG. 3B shows a directional sensitivity pattern of an ordinary light receiving element, in which the solid line part of droplet shape indicates relative sensitivities in angles with respect to the center axis of the element. It is seen from FIG. 3B that the light receiving element 21 is sensitive in the width of approximately 20°.

The reflecting member 40 is a member which is configured to reflect the incident light incident approximately normally thereto from the light emitting element 11, approximately in parallel with the incident light to make the light incident approximately normally to the light receiving element 21, and can be constructed, for example, of an optical prism of glass or acrylic resin with reflection planes angled at 90°, or the like. The reflecting member 40 does not have to be limited to the prism, but a configuration of combination of two mirrors angled at 90° can also be suitably applied.

The light emitting element 11 and the light receiving element 21 are mounted on the printed circuit board 32 so that the center axes of the respective elements (the center axes of the optical paths) are approximately parallel to each other. The cover 37 is provided with an emission slit 13 and a reception slit 23 formed around the center at the center axis of the respective elements.

In this configuration, the light emitted from the light emitting element 11 is restricted (or stopped down) by the emission slit 13 to become light with directivity along the center axis of the element. This detection light travels approximately normally across the sheet transport path 1 to reach the reflecting member 40.

The light incident into the reflecting member 40 travels through a plane 41, undergoes internal reflection at or above the critical angle on a plane 42 and a plane 43, and again travels through the plane 41; therefore, the reflected light exits as light approximately parallel and opposite to the incident light.

This reflected light again travels approximately normally across the sheet transport path 1 and then travels through the reception slit 23 to enter the light receiving element 21. On this occasion, the incident light is also restricted by the reception slit 23, so that only the reflected light along the center axis of the light receiving element 21 is incident into the interior. Therefore, the light receiving element 21 selectively detects only light with a high directional sensitivity pattern.

In this configuration, when no sheet S is present at the detection position, the light L emitted from the light emitting element 11 travels through the emission slit 13, is reflected by the reflecting member 40, and travels through the reception slit 23 to reach the light receiving element 21. When a sheet S is present at the detection position on the other hand, the light L emitted from the light emitting element 11 is shut off by the sheet S and does not reach the light receiving element 21. Namely, it is determined that a sheet is absent, with detection of light at the light receiving element 21, or it is determined that a sheet is present, without detection of light.

By employing the configuration wherein the center axes of the optical path of the irradiated light from the light emitting element 11 and the optical path of the incident light into the light receiving element 21 are approximately parallel to each other as described above, it is feasible to set the spacing freely between the light emitting and receiving unit 30 and the reflecting member 40 and set the spacing narrow between the light emitting element 11 and the light receiving element 21. Namely, since the sheet detecting device is constructed with the higher degree of freedom in structure and in smaller size, it becomes feasible to enhance the versatility of the device and, in turn, to fabricate the device at low cost.

Since the device is constructed in the configuration wherein the detection light is restricted by the emission slit 13 and the reception slit 23 and wherein the elements are covered by the cover 37 in the regions except for the slits, it is feasible to secure only the light necessary for the detection while shutting off the light traveling directly from the light emitting element 11 to the light receiving element 21 without passing through the reflecting member 40, the ambient light, etc., thereby enhancing the detection accuracy.

The configuration of the slits in the sheet detecting device of the present embodiment will be described below in further detail.

The description below will follow the following definition: the sheet transport direction is defined as a Y-direction, the direction perpendicular to the sheet transport direction as an X-direction, and the direction normal to the sheet surface of the transported sheet S as a Z-direction; rotation on the XY plane about the Z-axis is defined as rotation in an $\alpha$-direction, rotation on the ZX plane about the Y-axis as rotation in a $\beta$-direction, and rotation on the YZ plane about the X-axis as rotation in a $\gamma$-direction.

In the sheet detecting device of the present embodiment the light emitting element 11 and the light receiving element 21 are arranged as juxtaposed in the X-direction (the direction perpendicular to the sheet transport direction), as shown in FIGS. 1 and 2.

Figure 4:
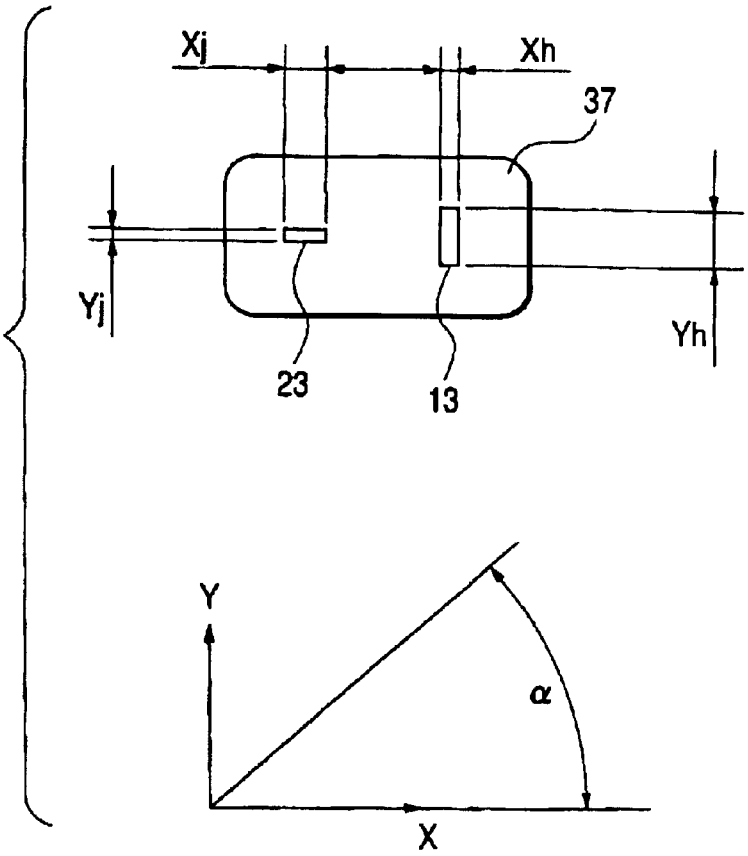
FIG. 4 is a schematic illustration showing a slit configuration of the sheet detecting device according to the embodiment of the present invention.

The emission slit 13 and the reception slit 23 both are rectangular through holes formed in the cover 37; as shown in FIG. 4, the emission slit 13 is arranged so as to be longitudinal along the Y-direction, and the reception slit 23 is arranged so as to be longitudinal along the X-direction.

Namely, the emission slit 13 is of such rectangular shape that the X-directional slit width Xh is smaller than the Y-directional slit width Yh, and the reception slit 23 is of such rectangular shape that the X-directional slit width Xj is greater than the Y-directional slit width Yj.

In this configuration, the X-directional width of the irradiated light is restricted at the emission slit 13, and the Y-directional width of the reflected light is restricted at the reception slit 23; therefore, the detected light becomes sufficiently small spot light. Further, since the Y-directional slit width of the reception slit 23 is set smaller, it is feasible to suppress variation in the sheet detection position on the light reception side and thus realize excellent position detection accuracy.

Let us consider herein the influence in situations with relative positional deviations between the light emitting and receiving unit 30 and the reflecting member 40. The relative positional deviations between the two members are six deviations in total including X-directional, Y-directional, and Z-directional parallel deviations and $\alpha$-directional, $\beta$-directional, and $\gamma$-directional rotational deviations.

When a relative positional deviation occurs in the X-direction, the spacing is widened or narrowed between the optical paths of the irradiated light from the light emitting element 11 and the reflected light from the reflecting member 40. Namely, the X-directional position of the incident light into the light receiving element 21 is shifted. In this respect, since the X-directional slit width Xj of the reception slit 23 is set wider in the present embodiment, the light is guided to the light receiving element 21 without loss in the quantity of incident light even if there occurs the shift of the X-directional position of the incident light.

Figure 5:
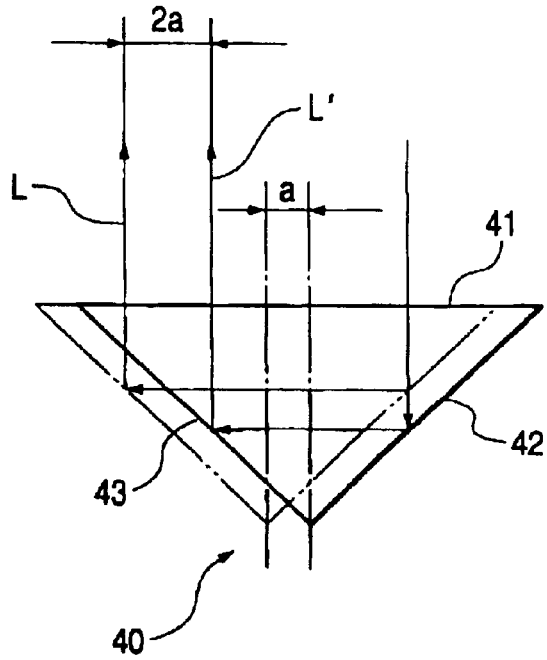
FIG. 5 is a diagram for explaining the influence of the relative positional deviation between the light emitting and receiving unit and the reflecting member on the optical path.

Now let us consider in further detail the influence on the optical path with occurrence of the relative positional deviation in the X-direction, with reference to FIG. 5. Supposing only the reflecting member 40 deviates by a distance "a" in the X-direction from the position indicated by a double-dotted line to the position indicated by a solid line, the light incident at the same position in the X-direction is turned back by the reflecting member 40 to pass an optical path of light L' shifted by a distance "2*a*" in the X-direction from the light L. Namely, the optical path deviates double the relative positional deviation in the X-direction between the light emitting and receiving unit 30 and the reflecting member 40. Accordingly, the X-directional (longitudinal) slit width Xj of the reception slit 23 is preferably set approximately two times or two or more times greater than the X-directional (transverse) slit width Xh of the emission slit 13.

The relative positional deviation in the Y-direction does not matter in particular. This is because the Y-directional width of the reflecting member 40 is sufficiently larger than the slit widths in the Y-direction.

The relative positional deviation in the Z-direction does not matter in particular, either. The reason is that the center axes of the optical paths of the irradiated light from the light emitting element 11 and the incident light into the light receiving element 21 are arranged approximately in parallel, as described above, and thus the spacing between the light emitting and receiving unit 30 and the reflecting member 40 scarcely affects the detection accuracy.

When there occurs the relative rotational deviation in the α-direction, the optical path of the reflected light from the reflecting member 40 deviates in the α-direction relative to the position of the reception slit 23 about the center at the optical path of the light emitting element 11. Namely, there occurs a deviation in the Y-directional position of the reflected light from the reflecting member 40. In this respect, since the Y-directional slit width Yh of the emission slit 13 is set wide in the present embodiment, the reflected light from the reflecting member 40 also has the width of approximately Yh in the Y-direction, and thus the incident light can be guided to the light receiving element 21 without loss in light quantity even if there is the deviation in the Y-directional position of the reflected light. There also occurs some deviation in the X-directional position of the incident light, but the X-directional positional deviation does not matter in the present embodiment, as described above.

When there occurs the relative rotational deviation in the β-direction, the incident light comes to have a positional deviation in the X-direction, as in the case of the relative positional deviation in the X-direction. In this respect, the X-directional positional deviation does not matter in the present embodiment, as described above.

When there occurs the relative rotational deviation in the γ-direction, the spacing between the optical paths of the irradiated light from the light emitting element 11 and the reflected light from the reflecting member 40 continuously varies in the Y-direction. Namely, the incident light into the light receiving element 21 has a positional deviation in the X-direction. In this respect, the X-directional positional deviation does not matter in the present embodiment, as described above.

As described above, even if there occurs the deviation in any direction between the relative positions of the light emitting and receiving unit 30 and the reflecting member 40, the slit configuration of the present embodiment is able to guide the light to the light receiving element 21 without loss in the light quantity of the incident light and perform stable detection without decrease in the S/N ratio.

In the present embodiment, the area of the emission slit 13 is set greater than the area of the reception slit 23. This is for the purpose of securing a large emission area in order to prevent occurrence of a situation in which light does not reach at part of the reception slit 23 with the relative positional deviation between the light emitting and receiving unit 30 and the reflecting member 40. However, unnecessary increase of the slit area will increase the quantity of reflected light from the sheet surface to cause decrease in the S/N ratio. Therefore, it is necessary to determine the area of the emission slit 13 within a permissible range of the quantity of the reflected light from the sheet surface.

The superiority of the slit configuration according to the present embodiment will be described below in comparison with the comparative examples shown in FIGS. 6A, 6B, and 6C.

Figure 6A:
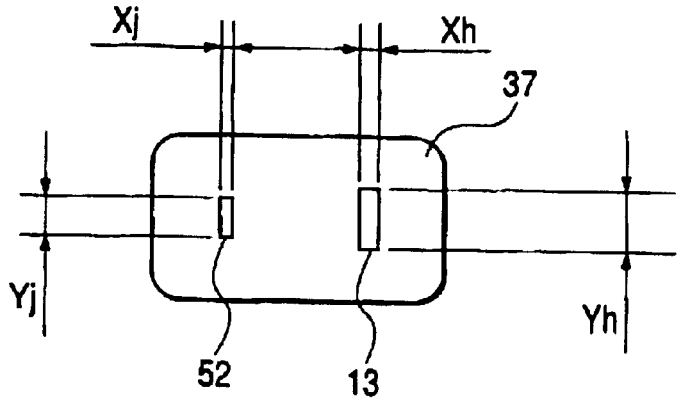
FIGS. 6A, 6B, and 6C are schematic illustrations showing comparative examples of the slit configuration.

FIG. 6A shows a slit configuration in which the reception slit 52 is arranged so as to be longitudinal along the Y-direction. In this case, the incident light into the light receiving element 21 has a considerable width in the Y-direction, so as to degrade the Y-directional position detection accuracy of the sheet. When there occurs a positional deviation in one of the X-direction, the β-direction, and the γ-direction, the optical path of the reflected light from the reflecting member 40 deviates away from the reception slit 52 to decrease the quantity of received light at the light receiving element 21, thereby making stable detection difficult.

Figure 6B:
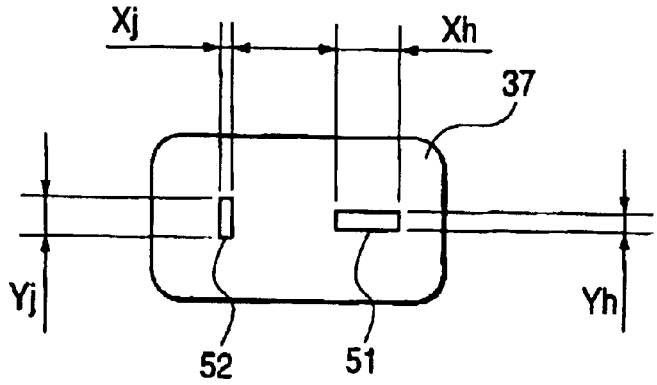

FIG. 6B shows a slit configuration in which the emission slit 51 is arranged so as to be longitudinal along the X-direction and the reception slit 52 longitudinal along the Y-direction. In this case, as passing through the two slits, the detection light is restricted in the X-direction and in the Y-direction to become spot light, but there occurs variation in the sheet detection position because of the considerable Y-directional width of the reception slit 52, so as to degrade the position detection accuracy. If the Y-directional width Yh of the emission slit 51 is set narrower, the light quantity will tend to decrease with occurrence of a positional deviation in the Y-direction or a deviation in the γ-direction even if the Y-directional width Yj of the reception slit 52 is set wide, because the Y-directional width Yh of the emission slit 51 is dominant.

Figure 6C:
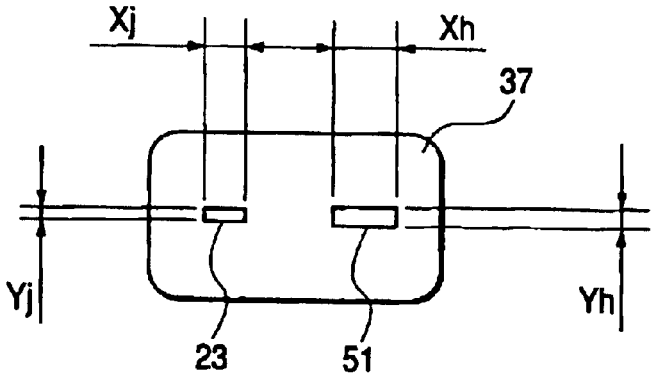

FIG. 6C shows a slit configuration in which the emission slit 51 is arranged so as to be longitudinal along the X-direction. In this case, the spacing becomes narrower between the emission slit 51 and the reception slit 23, so that the reflected light from the sheet becomes apt to enter the light receiving element 21, so as to cause the decrease in the S/N ratio. As the Z-directional spacing becomes wider between the light emitting and receiving unit 30 and the sheet S, the decreasing tendency of the S/N ratio becomes stronger. When there occurs a rotational deviation in the α-direction, the optical path of the reflected light from the reflecting member 40 deviates away from the reception slit 52, so as to decrease the quantity of the received light at the light receiving element 21, thereby making stable detection difficult.

Figure 7:
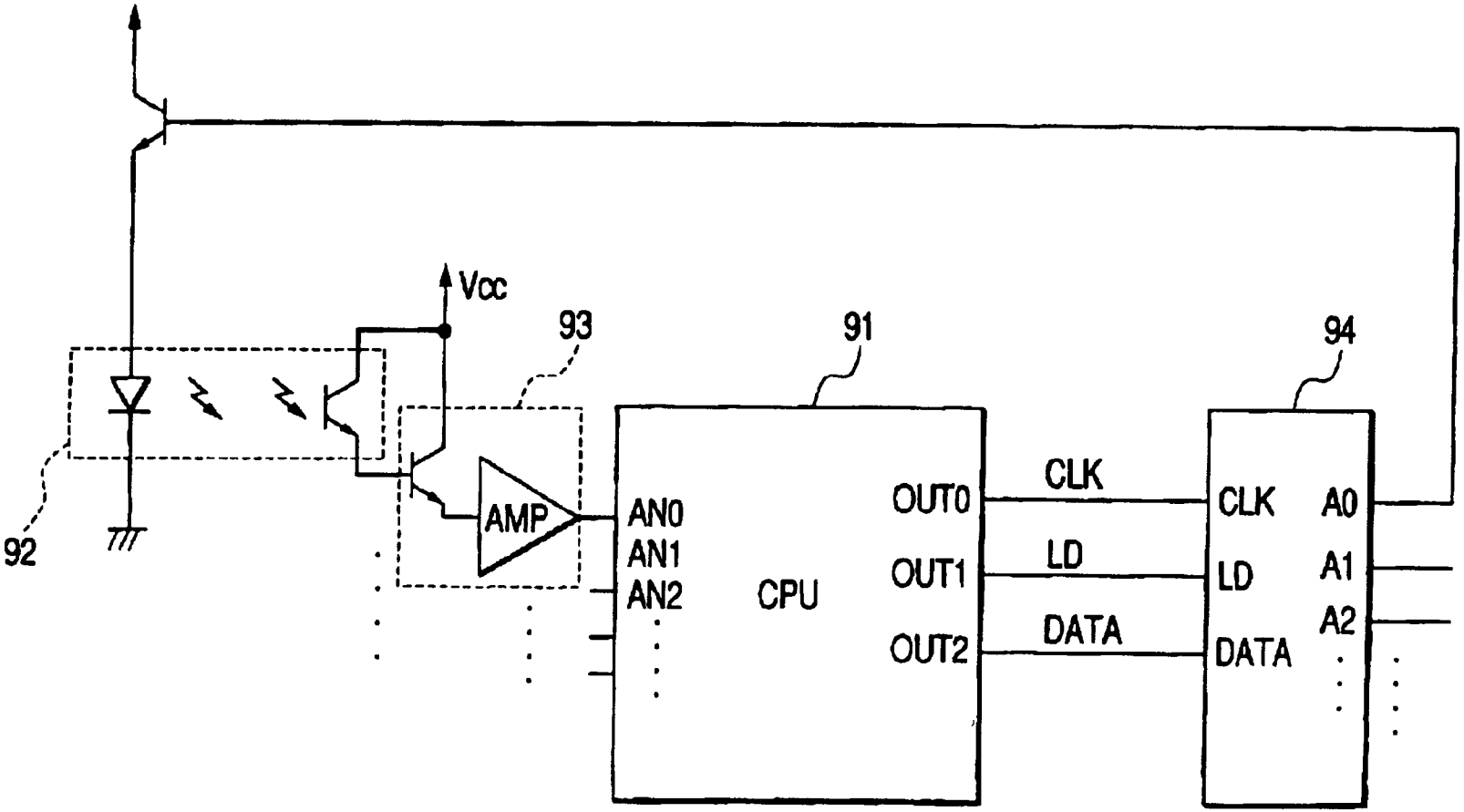
FIG. 7 is a block diagram showing a configuration of a control electric circuit of the sheet detecting device according to an embodiment of the present invention.

The optimal light quantity of the light emitting element 11 is controlled by an electric circuit described below. FIG. 7 is a block diagram showing a configuration of the electric circuit to perform the control of the sheet detecting device.

An analog signal, which is an electric signal converted from light received at the light receiving element 92, is fed into an analog input portion AN0 of a central processing unit (hereinafter referred to as CPU) 91. The input analog signal is subjected to A/D conversion inside the CPU 91, to be converted into one of 256-level digital values.

A signal amplifying portion 93 and an analog input portion are provided for each of sheet detecting devices (sensors) in the sheet transport path 1.

Output portions OUT0, OUT1, and OUT2 of the CPU 91 are coupled to a D/A converter 94. Receiving a clock (CLK), a load signal (LD), and digital data of serial code (DATA), the D/A converter 94 sequentially outputs analog outputs of several channels (A0, A1, . . . ).

The light quantity of the light emitting element can be varied by letting an electric current based on one of the analog signals, pass through the light emitting element of the sheet detecting device provided in the sheet transport path 1.

When the level of the signal sent through the analog input portion exceeds a certain threshold, the CPU 91 determines that the reflected light is received. Accordingly, the CPU 91 performs such control as to gradually increase the output of the D/A converter 94 before the level of the signal sent through the analog input portion exceeds the certain threshold, and to fix the output data once the signal level exceeds the threshold. According to this method, the CPU sets the minimum quantity of emitted light that can be detected by the light receiving element 92.

As described above, the sheet detecting device of the present embodiment is able to perform the stable detection with the S/N ratio being maintained high even with the relative positional deviation between the reflecting member 40 and the light emitting and receiving unit 30. In addition, it is also feasible to improve the position detection accuracy in the sheet transport direction.

The sheet detecting device as described above is suitably applicable to the various image forming apparatus such as the printers, copying machines, facsimile machines, and so on (or the sheet transporting device in the image forming apparatus) This permits highly accurate detection of the position of the leading edge or the trailing edge of the transported sheet and thus permits accurate control of sheet transportation and image formation based on the detection timing.

Although the slits in the present embodiment were formed in the rectangular shape, the shape of the slits does not have to be limited to the rectangular shape; for example, the slits may be formed in shape like an oblong circle and an ellipse. Namely, the effect similar to the above can be achieved as long as the slits are configured so that they are formed in a slit shape having the longitudinal direction and the transverse direction and so that the emission slit is arranged so as to be longitudinal along the sheet transport direction and the reception slit longitudinal along the direction perpendicular to the sheet transport direction.

The following will describe a sheet detecting device having the effect of preventing reflection and entry of detected light, on the basis of FIG. 8 and FIGS. 9A to 9C.

First, the schematic configuration of the sheet detecting device will be described with reference to FIGS. 9A to 9C.

Figure 9A:
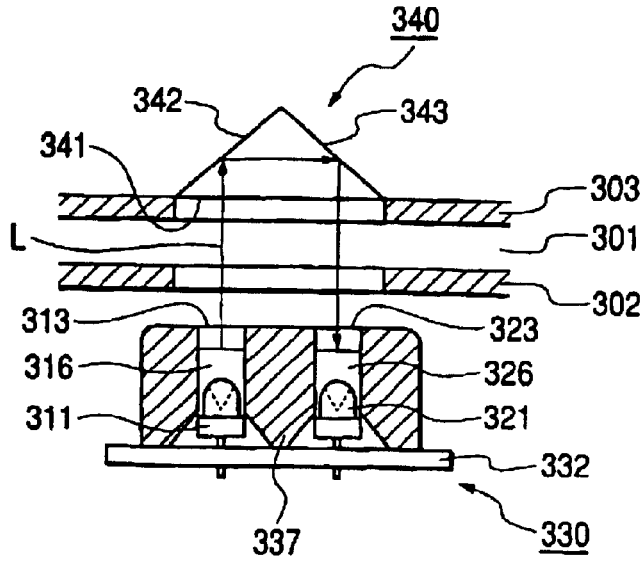
FIGS. 9A, 9B, and 9C are schematic sectional views showing a configuration of a sheet detecting device according to the embodiment of FIG. 8.
Figure 9B:
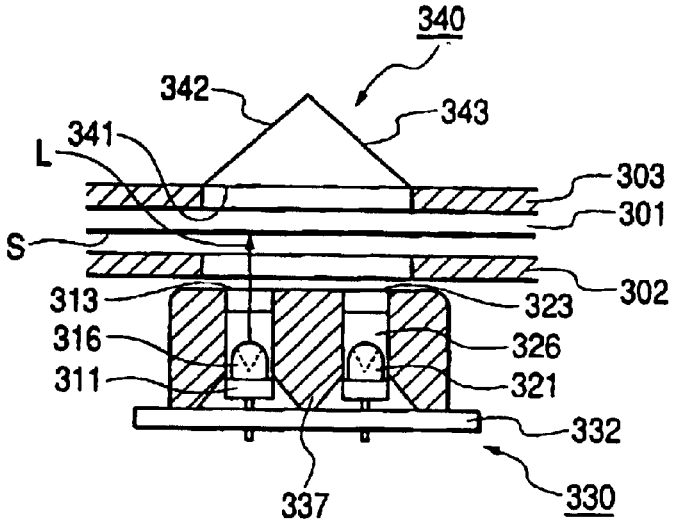
Figure 9C:
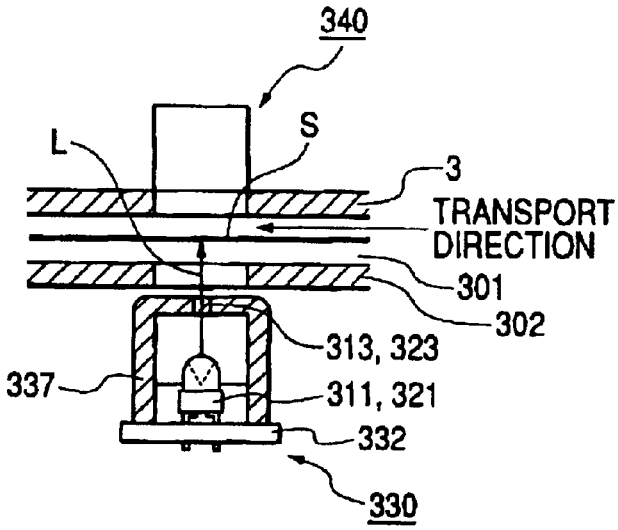

FIGS. 9A to 9C are schematic sectional views showing the configuration of the sheet detecting device according to the present embodiment. FIGS. 9A and 9B are the schematic sectional views from the sheet transport direction, wherein FIG. 9A shows a case in which no sheet is present in the sheet transport path and FIG. 9B a case in which a sheet is being transported through the sheet transport path to be detected. FIG. 9C is the schematic sectional view as looked from the side of the state of FIG. 9B (i.e., in the direction perpendicular to the sheet transport direction).

The sheet transport path 301 is a space provided for transporting a sheet S between a sheet guide 302 and a sheet guide 303, through which the sheet S is transported by the transporting roller (not shown). The sheet S as an object to be detected, having been transported, is detected by the sheet detecting device provided in the middle of the sheet transport path 301. The control of transportation such as the transport timing of the sheet S or the like is performed based on the result of the detection.

The sheet detecting device of the present embodiment is a transmissive photosensor, which is generally comprised of a light emitting and receiving unit 330 in which a light emitting element 311 and a light receiving element 321 are mounted on a common printed circuit board 332, and a reflecting member 340 configured to reflect the detection light L emitted from the light emitting element 311 and make the detection light incident into the light receiving element 321. The light emitting and receiving unit 330 and the reflecting member 340 are placed at respective positions so as to be opposed to each other with the sheet transport path 301 between.

The light emitting and receiving unit 330 is constructed in the configuration in which the light emitting element 311 for emitting the detection light and the light receiving element 321 for receiving the detection light are mounted on the printed circuit board 332 and a cover 337 for separately covering these elements is attached thereto.

The light emitting element 311 and the light receiving element 321 are mounted on the printed circuit board 332 so that the center axes of the respective elements (the center axes of the optical paths) are approximately parallel to each other. The cover 337 is of two-chamber structure having a partition midway between the light emitting element 311 and the light receiving element 321, and has a light emitting element chamber 316 embracing the light emitting element 311 and a light receiving element chamber 326 embracing the light receiving element 321. The light emitting element chamber 316 is provided with an emission slit 313 formed around the center on the element center axis of the light emitting element 311, and the light receiving element chamber 326 is provided with a reception slit 323 formed around the center on the element center axis of the light receiving element 321.

By employing the above-stated configuration wherein the detection light is restricted by the emission slit 313 and the reception slit 323 and the elements are covered by the cover 337 in the regions other than the slits, it is feasible to secure only the light necessary for the detection and shut off the light traveling directly from the light emitting element 311 to the light receiving element 321 without passing through the reflecting member 340, the ambient light, etc., thereby improving the detection accuracy.

The light emitting element 311 can be constructed, for example, of an infrared emitting diode or the like, and the description thereof is omitted herein, because it is the same as the light emitting element 11 in FIGS. 3A and 3B.

The configuration of the printed circuit board in the sheet detecting device of the present embodiment will be described below in detail with reference to FIG. 8.

Figure 8:
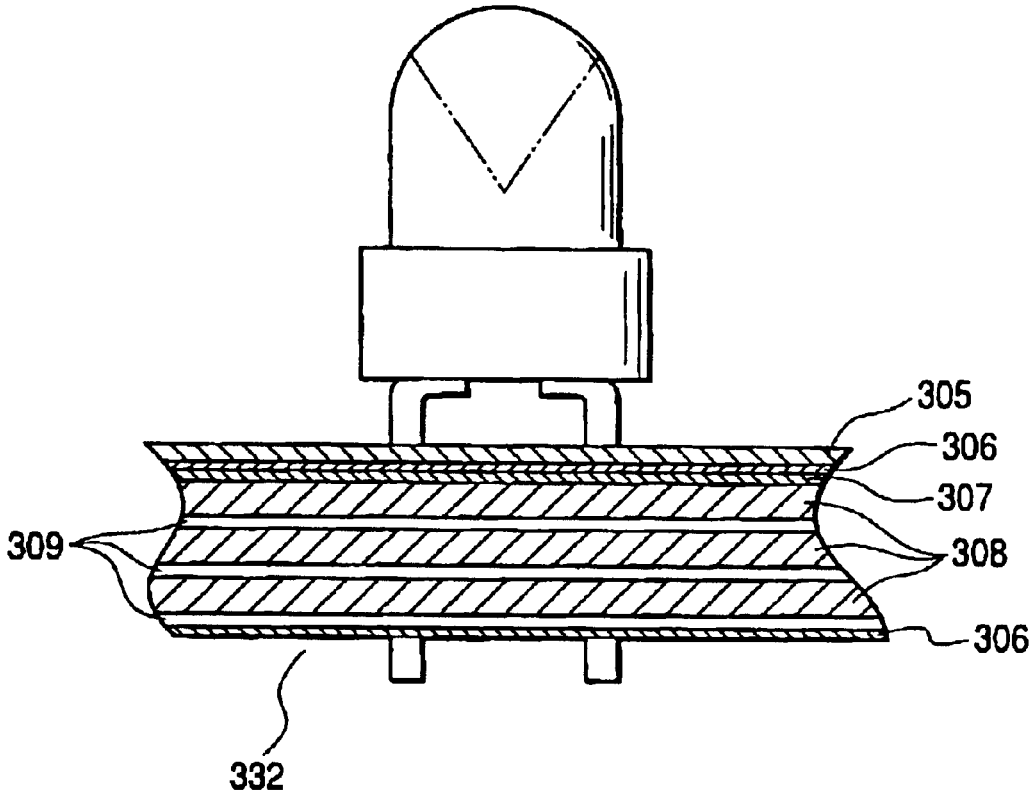
FIG. 8 is a schematic sectional view showing a layer configuration of a printed circuit board of the sheet detecting device having the effect of preventing reflection and entry of detection light.

The printed circuit board 332 is, as shown in FIG. 8, a four-layered board consisting of the following layers in order from the mounting surface of the light emitting element and the light receiving element: a solid black silk-screen-printed layer 305 as an antireflective layer for preventing reflection of the detection light, a printed resist layer 306 for preventing solder from attaching to unwanted portions, a solid GND pattern layer 307 as an entry preventing layer for preventing entry of the detection light, a glass cloth epoxy resin 308 as a base material, a copper foil layer 309 formed in an electric circuit pattern, a glass cloth epoxy resin 308 as a base material, a copper foil layer 309 formed in an electric circuit pattern, a glass cloth epoxy resin 308 as a base material, a copper foil layer 309 formed in an electric circuit pattern, and a printed resist layer 306 for preventing solder from attaching to unwanted portions.

The solid black silk-screen-printed layer 305 is a layer formed by silk screen printing with black ink. The black ink has the property of absorbing the majority of received light but reflecting or transmitting extremely little light.

The solid black silk-screen-printed layer 305 is formed at least in the range including the region exposed in the light emitting element chamber 316 out of the printed circuit board 332 and is preferably formed in the region exposed in the light receiving element chamber 326 as well. Of course, it is also preferable to form the layer 305 throughout the almost entire surface of the printed circuit board 332.

The solid GND pattern layer 307 is a pattern for providing the earth (GND) for the circuits and is formed in a wider range (in solid form) than the ordinary wiring patterns. Since the pattern layer 307 is made of an electrically conductive metal material, the received light is shut off (reflected or absorbed) and is thus rarely transmitted.

The region where the solid GND pattern layer 307 is formed may be made approximately coincident with the region where the solid black silk-screen-printed layer 305 is formed. It is, however, to be noted that no short occurs between the pattern layer 307 and the wiring patterns.

As described above, the detection light emitted from the light emitting element is directly or indirectly incident to the surface of the printed circuit board 332. In the configuration of the present embodiment, however, the majority of the light incident into the printed circuit board 332 is absorbed by the solid black silk-screen-printed layer 305 and some light transmitted by the solid black silk-screen-printed layer 305 is shut off by the solid GND pattern layer 307; it is, therefore, feasible to effectively prevent entry of the light into the base material of the printed circuit board 332.

The configuration of the printed circuit board does not have to be limited to the four-layered board, but it may be, for example, a double-sided board consisting of the following layers in order from the mounting surface side of the light emitting element and the light receiving element: a solid black silk-screen-printed layer as an antireflection layer, a printed resist layer, a solid GND pattern layer as an entry preventing layer, a glass cloth epoxy resin as a base material, a copper foil layer, and a printed resist layer. A white silk-screen-printed layer, which indicates mounting of electric parts, may also be further provided in the regions except for the mount surfaces immediately before the light emitting element and the light receiving element.

The method of setting the optimal quantity of emitted light from the light emitting element 311 is the same as in FIG. 7 and thus the description thereof is omitted herein.

As described above, since the sheet detecting device of the present embodiment is provided with the solid black silk-screen-printed layer 305 and the solid GND pattern layer 307 in order between the element mounting surface and the base material of the printed circuit board 332, it is feasible to prevent or decrease the noise light detected through the interior of the printed circuit board 332 by the light receiving element 321.

Therefore, the S/N ratio becomes higher for the light detected at the light receiving element 321 and the stable detection of the sheet can be always performed even in the case where the quantity of the emitted light from the light emitting element 311 is controlled at a low level or in the case where the reflectance is low because of contamination of the reflecting member 340 or the like.

Since there is no need for consideration to the influence of noise light, it is feasible to narrow the spacing between the light emitting element 311 and the light receiving element 321, and the printed circuit board 332 and to narrow the spacing between the light emitting element 311 and the light receiving element 321, thereby permitting the decrease in the size of the sheet detecting device.

Figure 10A:
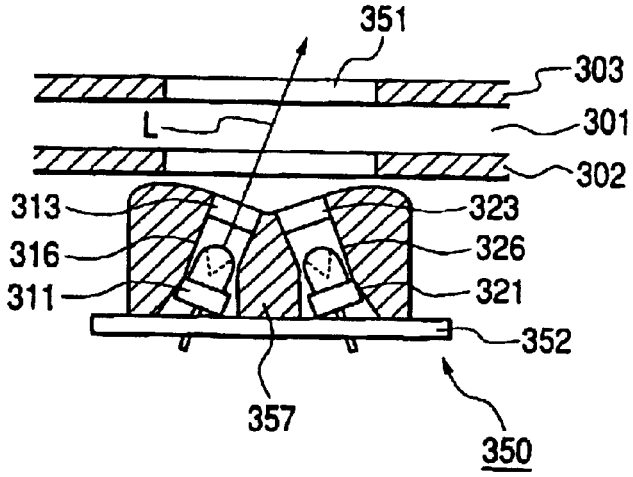
FIGS. 10A, 10B, and 10C are schematic sectional views showing a configuration of a sheet detecting device according to another embodiment different from FIGS. 9A to 9C.
Figure 10B:
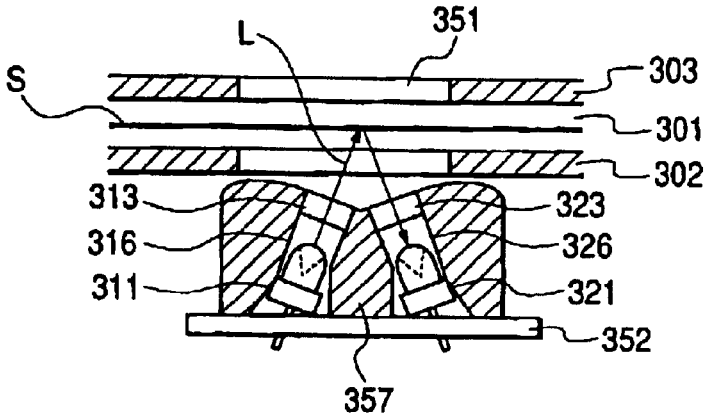
Figure 10C:
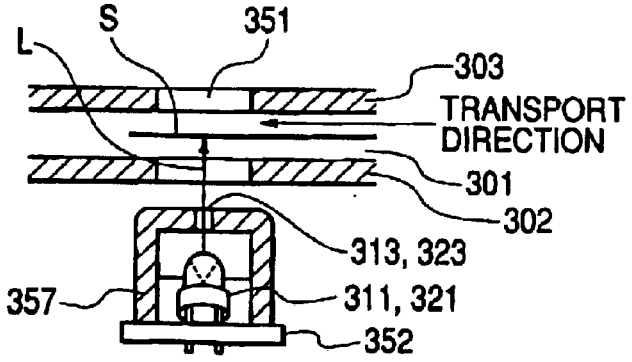

FIGS. 10A to 10C show an embodiment different from FIGS. 9A to 9C. The embodiment of FIGS. 9A to 9C described the example of application of the present invention to the transmissive photosensor, whereas the present embodiment describes another example of application of the present invention to a reflective photosensor.

The same constitutive portions as in the embodiment of FIGS. 9A to 9C will be denoted by the same reference symbols, detailed description thereof will be omitted herein, and the description will be given with focus on the different constitutive portions.

FIGS. 10A to 10C are schematic sectional views showing the configuration of the sheet detecting device according to the present embodiment. FIGS. 10A and 10B are the schematic sectional views as looked in the sheet transport direction, wherein FIG. 10A shows a case in which no sheet is present in the sheet transport path and FIG. 10B a case in which a sheet is being transported through the sheet transport path to be detected. FIG. 10C is the schematic sectional view as looked from the side of the state of FIG. 10B (i.e., from the direction perpendicular to the sheet transport direction).

In the sheet detecting device of the present embodiment the light emitting and receiving unit 350 is generally constructed in a configuration in which the light emitting element 311 for emitting the detection light and the light receiving element 321 for receiving the detection light are mounted on the printed circuit board 352 and the cover 357 for separately covering these elements is attached thereto.

The light emitting element 311 and the light receiving element 321 are mounted on the printed circuit board 352 so that their respective center axes (the center axes of the optical paths) cross each other in the middle portion of the sheet transport path 301.

The cover 357 is of the two-chamber structure having a partition midway between the light emitting element 311 and the light receiving element 321, and has the light emitting element chamber 316 embracing the light emitting element 311 and the light receiving element chamber 326 embracing the light receiving element 321. The light emitting element chamber 316 is provided with the emission slit 313 formed around the center on the center axis of the light emitting element 311, and the light receiving element chamber 326 is provided with the reception slit 323 formed around the center on the center axis of the light receiving element 321.

The sheet guide 302 is provided with an aperture portion 351 as a non-reflecting portion so as not to reflect the light emitted from the light emitting element 311, and is thus configured to transmit light.

When no sheet S is present as shown in FIG. 10A, the detection light L emitted from the light emitting element 311 passes through the aperture portion 351 of the sheet guide 302 and thereafter travels without being reflected anywhere, so as not to return to the light receiving element 321. When a sheet S is present on the other hand as shown in FIG. 10B, the detection light L emitted from the light emitting element 311 passes the emission slit 313, is reflected by the sheet S, and then passes the reception slit 323 to reach the light receiving element 321. Namely, the presence of the sheet is determined with detection of the detection light at the light receiving element 321, while the absence of the sheet is determined without detection of the detection light.

In the case of the reflective photosensor just as described, the effect similar to that in the embodiment of FIGS. 9A to 9C can also be achieved by employing the layer structure as shown in FIG. 8, for the configuration of the printed circuit board 352 with the light emitting element 311 and the light receiving element 321 mounted thereon.

Namely, by providing the solid black silk-screen-printed layer as an antireflective layer and the solid GND pattern layer as an entry preventing layer in order between the element-mounted surface and the base material of the printed circuit board 352, it is feasible to prevent or decrease the noise light detected through the interior of the printed circuit board 352 by the light receiving element 321.

Accordingly, the S/N ratio is maintained high for the light detected at the light receiving element 321, so that the stable detection of the sheet can be always performed even in the case where the quantity of emitted light from the light receiving element 311 is controlled at a low level, or in the case where the sheet has a low reflectance (e.g., a solid black sheet or the like).

Since there is no need for consideration to the influence of the noise light, it is feasible to narrow the spacing between the light emitting element 311 and the light receiving element 321, and the printed circuit board 352 and to narrow the spacing between the light emitting element 311 and the light receiving element 321, thereby decreasing the size of the sheet detecting device.

As described above, the present embodiment employs the configuration wherein the antireflective layer for preventing reflection of the detection light and the entry preventing layer for preventing entry of the detection light into the base material are provided in order between the element-mounted surface and the base material of the printed circuit board, so that it becomes feasible to decrease the noise light detected through the interior of the printed circuit board by the light receiving element, to raise the S/N ratio, and to constantly perform the stable detection of the sheet.

The following will describe the transported sheet detecting devices 481, 482, and 483 of respective embodiments in which the leading edge sensor 205 is made difficult to tip (or slant).

(Transported Sheet Detecting Device of First Embodiment)

The transported sheet detecting device 481 of the first embodiment will be described on the basis of FIGS. 11A to 11C.

Figure 11A:
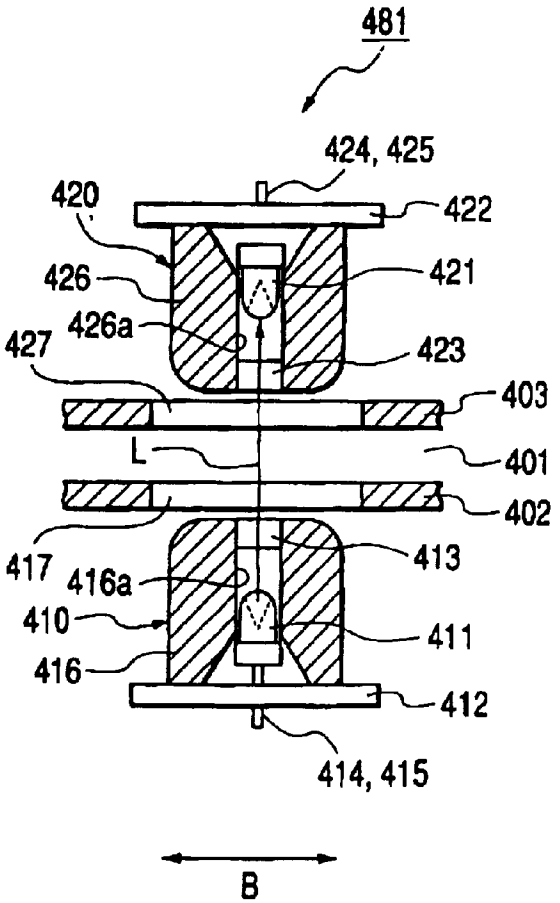

FIG. 11A is a sectional view along the direction intersecting with the sheet transport direction of the transported sheet detecting device 481. FIG. 11B is a sectional view along the direction intersecting with the sheet transport direction of the transported sheet detecting device 481, and is a view of a sheet detecting state. FIG. 11C is a sectional view along the sheet transport direction of the transported sheet detecting device 481 and is a view of a sheet detecting state.

The transported sheet detecting device 481 is provided with a light emitting unit 410 and a light receiving unit 420 disposed opposite to each other on the both sides of the sheet transport path (sheet transportation passage) 401. The sheet transport path 401 is composed of parallel sheet guides 402, 403, for guiding the sheet transported by the registration rollers 204 and the transporting rollers 202. The sheet guides 402, 403 are provided with their respective through holes 417, 427 for letting the light L from the light emitting element 411 described hereinafter, pass therethrough.

Figure 11B:
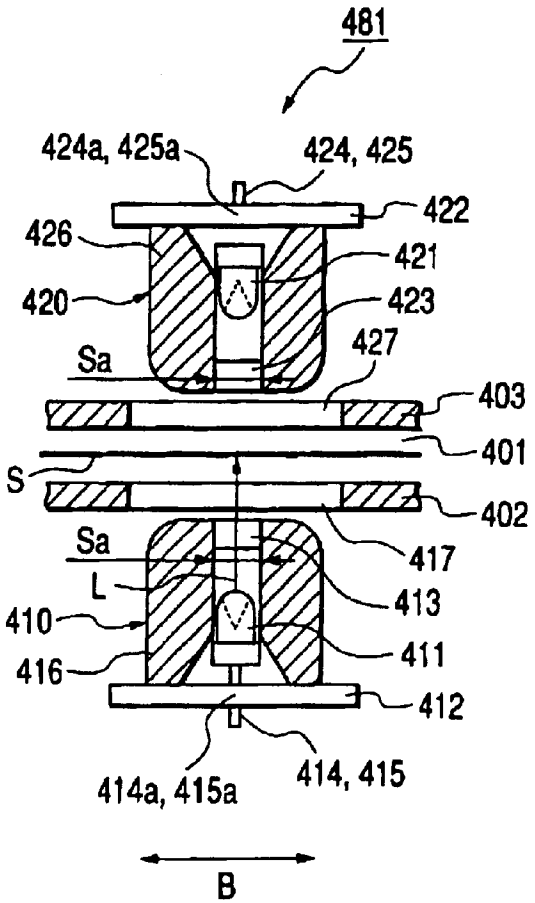
Figure 11C:
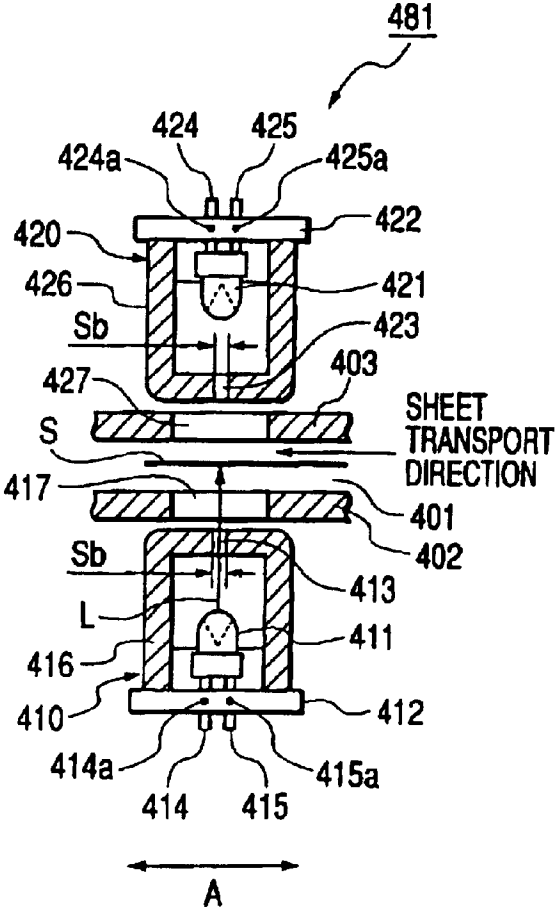

The sheet is transported in the direction from front to back of the drawing in FIGS. 11A and 11B, and from right to left of the drawing in FIG. 11C.

The light emitting unit 410 is comprised of a light emitting element 411 for emitting light, a printed circuit board (mount member) 412 on which the light emitting element 411 is mounted, and a case member (tip preventing member) 416. The light emitting element 411 is constructed, for example, of an infrared emitting diode. The infrared emitting diode does not emit perfect parallel light but emits light with some spread as shown in FIG. 3A.

The case member 416 is provided with a slit 413, and a guide hole 416*a* in which the light emitting element 411 is set. The slit 413 is formed for the purpose of restricting the light emitted from the light emitting element 411 to provide the light with directivity.

The light receiving unit 420 is comprised of a light receiving element 421, a printed circuit board (mount member) 422 on which the light receiving element 421 is mounted, and a case member (tip preventing member) 426. The light receiving element 421 is constructed, for example, of a phototransistor. The phototransistor is configured not to react only to the parallel light but also react to the light from the side to some extent as shown in FIG. 3B, and to photoelectrically transfer the received light into a photocurrent.

The case member 426 is provided with a slit 423, and a guide hole 426*a* in which the light receiving element 421 is set. The slit 423 is formed for the purpose of restricting the light received at the light receiving element 421 to provide the light with directivity.

The light emitting element 411 has two electrode wires 414, 415 extending on the opposite side to the direction of emission of the light conically spreading about the center on the center axis of the light emitting element 411. The light receiving element 421 also has two electrode wires 424, 425 extending on the opposite side to the light receiving surface in the receiving directions of light conically spreading about the center on the center axis of the light receiving element 421.

The light emitting element 411 is mounted on the printed circuit board 412 while the two electrode wires 414, 415 are fitted in holes 414*a*, 415*a* arranged in the sheet transport direction in the printed circuit board 412. Accordingly, the two electrode wires 414, 415 are arranged in the sheet transport direction.

The light receiving element 421 is mounted on the printed circuit board 422 while the two electrode wires 424, 425 are fitted in holes 424*a*, 425*a* arranged in the sheet transport direction in the printed circuit board 422. Accordingly, the two electrode wires 424, 425 are arranged in the sheet transport direction.

The light emitting element 411 is difficult to tip in directions in which the electrode wires 414, 415 appear superimposed (i.e., in directions indicated by the double-headed arrows A in FIG. 11C), in the mounted state on the printed circuit board 412. Namely, the light emitting element 411 is difficult to tip upstream and downstream in the sheet transport direction. However, the light emitting element 411 can possibly tip in directions intersecting with the directions in which the electrode wires 414, 415 appear superimposed (i.e., it can possibly tip in directions indicated by the double-headed arrows B in FIGS. 11A and 11B). For this reason, the guide hole 416*a* of the case member 416 works to prevent the tip of the light emitting element 411. If the guide member 416 were not provided with the guide hole 416*a* and if the light emitting element 411 were forced to be tipped in the directions indicated by the double-headed arrows B intersecting with the directions in which the electrode wires 414, 415 appear superimposed, the pattern of the printed circuit board 412 could be peeled.

The light receiving element 421 is difficult to tip in the directions in which the electrode wires 424, 425 appear superimposed (i.e., in the directions indicated by the double-headed arrow A in FIG. 11C), in the mounted state on the printed circuit board 422. Namely, the light receiving element 421 is difficult to tip upstream and downstream in the sheet transport direction. However, it can possibly tip in the directions intersecting with the directions in which the electrode wires 424, 425 appear superimposed (i.e., it can possibly tip in the directions indicated by the double-headed arrows B in FIGS. 11A and 11B). For this reason, the guide hole 426*a* of the case member 426 works to prevent the tip of the light receiving element 421. If the case member 426 were not provided with the guide hole 426*a* and if the light receiving element 421 were forced to be tipped in the directions indicated by the double-headed arrows B intersecting with the directions in which the electrode wires 424, 425 appear superimposed, the pattern of the printed circuit board 422 could be peeled.

As shown in FIGS. 11A, 11B, and 11C, the sheet transport direction is coincident with the direction of arrangement of the electrode wires 414, 415 of the light emitting element 411 and the direction of arrangement of the electrode wires 424, 425 of the light receiving element 421, and the longitudinal direction of the slits 413, 423 is perpendicular to the sheet transport direction. Namely, the slits 413, 423 are formed in the orientation perpendicular to the sheet transport direction in the respective case members 416, 426.

Figure 12:
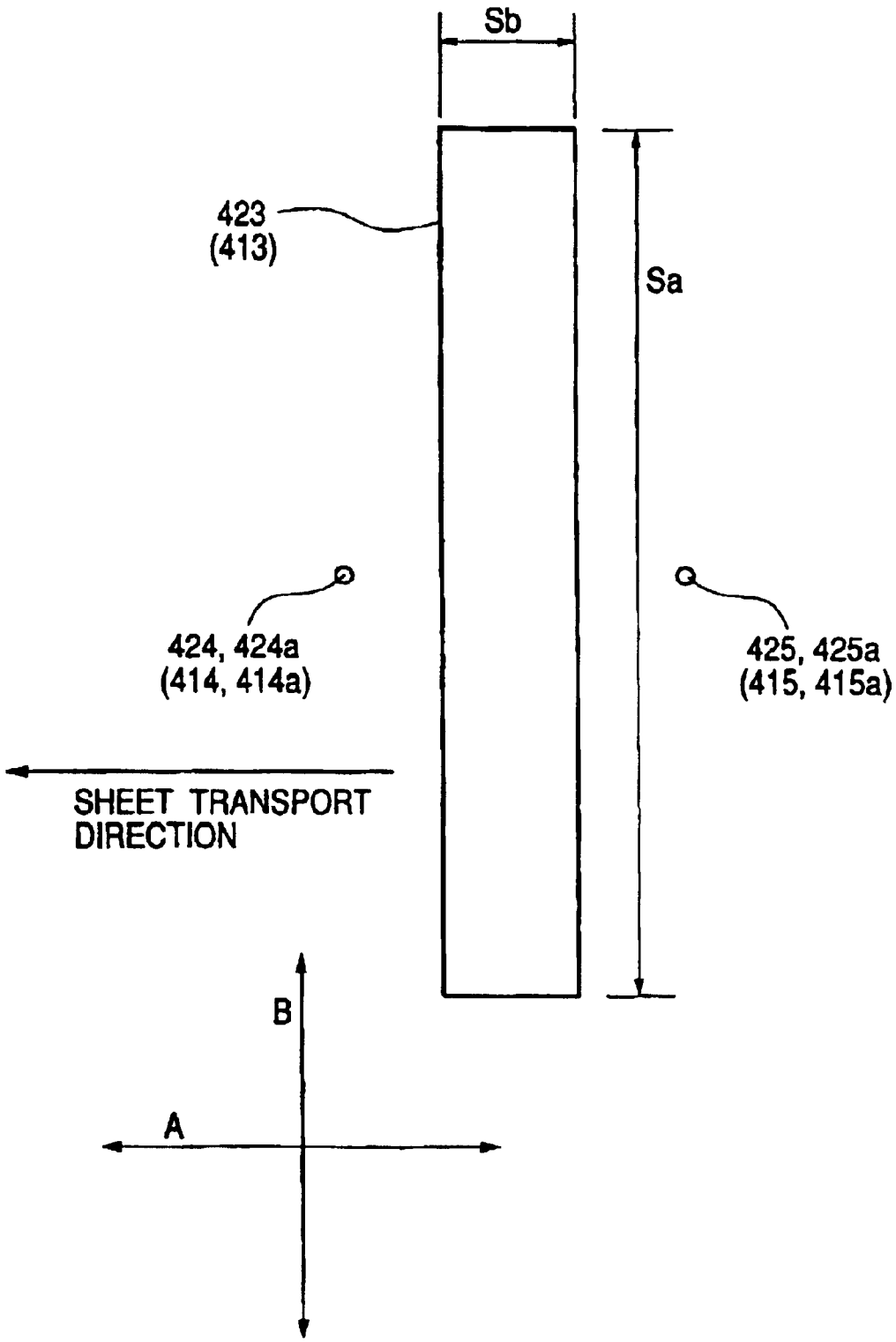
FIG. 12 is an illustration of a slit.

The slits 413, 423 are formed in the shape shown in FIG. 12. The slit width Sb in the directions of a straight line connecting the two holes 414*a*, 415*a* provided in the printed circuit board 412 with the light emitting element 411 mounted thereon (or in the sheet transport direction) and the slit width Sb in the directions of a straight line connecting the two holes 424*a*, 425*a* provided in the printed circuit board 422 with the light receiving element 421 mounted thereon (or in the sheet transport direction) are set smaller (or shorter) than the slit width (length) Sa in the directions intersecting with the straight line connecting the two holes 414*a*, 415*a* (the directions indicated by the double-headed arrow B) and the slit width (length) Sa in the directions intersecting with the straight line connecting the two holes 424*a*, 425*a* (the directions indicated by the double-headed arrow B). Namely, the slits 413, 423 are formed in the orientation perpendicular to the sheet transport direction in the respective case members 416, 426.

The shape of the slits 413, 423 is defined so that the slit width (length) Sa in the direction perpendicular to the transport direction of the sheet S is set wider (longer) so as to secure the light quantity by the degree of restricting the light quantity by narrowing the slit width Sb along the transport direction of the sheet S, in order to enhance the sheet detection accuracy of the sheet S, and it is preferable to set wider the slit width in the direction in which it is harder to ensure the position accuracy, from the relation of mounting position accuracies of the light emitting unit 410 and the light receiving unit 420.

The electric circuit of the control unit is the same as in FIG. 7 and the description thereof is omitted herein.

The operation of the transported sheet detecting device 481 of the first embodiment will be described below.

When no sheet S is transported yet to the detection position, as shown in FIG. 11A, the light L emitted from the light emitting element 411 passes through the slit 413, the through holes 417, 427, and the slit 423 to reach the light receiving element 421. When a sheet S is transported up to the detection position, as shown in FIGS. 11B and 11C, the light L emitted from the light emitting element 411 is shut off by the sheet S and does not reach the light receiving element 421.

Accordingly, the transported sheet detecting device 481 of the first embodiment is configured to determine the absence of the sheet with detection of light at the light receiving element 421 and the presence of the sheet without detection of light.

Since in the transported sheet detecting device 481 of the present embodiment the electrode wires of the light emitting element 411 and the light receiving element 421 are arranged in the sheet transport direction, as shown in FIG. 11C, the light emitting element 411 and the light receiving element 421 are difficult to tip in the same direction. For this reason, even in the case of the width of the slits being narrowed in the sheet transport direction, the light emitting element 411 and the light receiving element 421 can be accurately placed so as to match the slits, so that it is feasible to let the light from the light emitting element securely pass the slits, increase the dynamic range of the light receiving element, and enhance the sheet detection accuracy for detection of the presence and absence of the sheet in the transported sheet detecting device 481.

There occurs no deviation of the opposite positions of the light emitting element 411 and the light receiving element 421 to the slits even after long-term use, so that it is feasible to maintain the sheet detection accuracy constant over a long period of time.

Further, the dynamic range of the light receiving element is widened by letting the light from the light emitting element securely pass the slits, but the narrowing of the slits decreases the quantity of light passing through the slits by that degree. The decrease is compensated for by widening the slit width (Sa) in the direction perpendicular to the sheet transport direction (or by lengthening the length of the slits), whereby it is feasible to expand the dynamic range more and securely detect the sheet.

Even if the light emitting element 411 and the light receiving element 421 should come to tip in the lateral directions in the state in which the electrode wires appear one on a projection, the guide holes 416*a*, 426*a* of the case members 416, 426 would prevent the tip.

Further, when a copying machine is equipped with the foregoing transported sheet detecting device 481 in the main body, it is able to accurately form an image on the transported sheet.

(Transported Sheet Detecting Device of Second Embodiment)

The transported sheet detecting device 482 of the second embodiment will be described on the basis of FIGS. 13A to 13C.

Figure 13A:
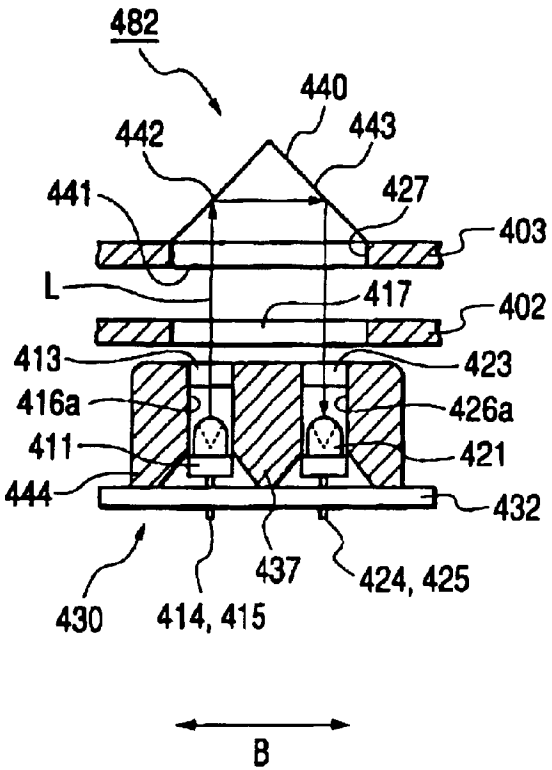

FIG. 13A is a sectional view along the direction intersecting with the sheet transport direction of the transported sheet detecting device 482. FIG. 13B is a sectional view along the direction intersecting with the sheet transport direction of the transported sheet detecting device 482, and is a view of a sheet detecting state. FIG. 13C is a sectional view along the sheet transport direction of the transported sheet detecting device 482 and is a view of a sheet detecting state.

In the transported sheet detecting device 482 of the second embodiment, the same portions as those in the transported sheet detecting device 481 of the first embodiment will be denoted by the same reference symbols and the description will be omitted in part.

Figure 13B:
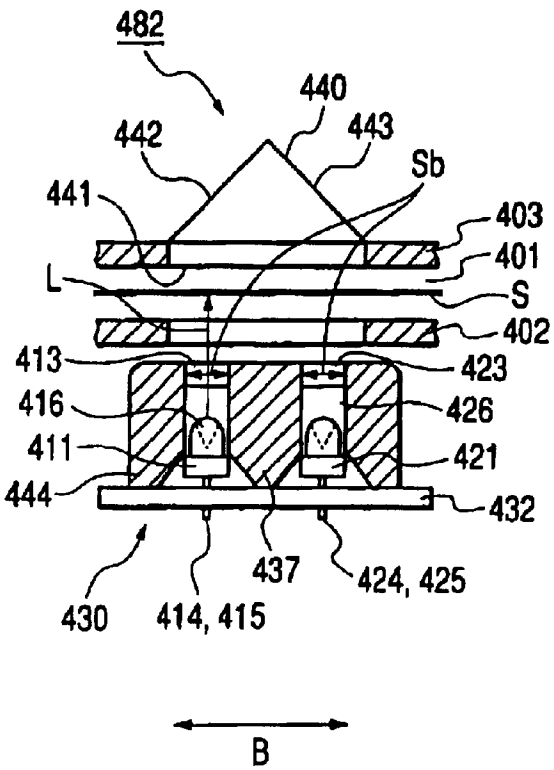
Figure 13C:
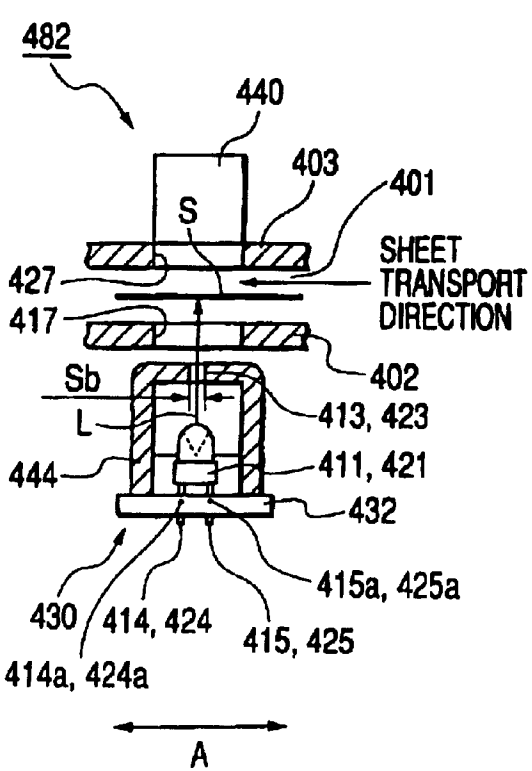

FIGS. 13A, 13B, and 13C correspond to FIGS. 11A, 11B, and 11C, respectively. The light emitting unit 410 and the light receiving unit 420 are disposed opposite each other with the sheet transport path 401 between in the transported sheet detecting device 481 of the first embodiment, whereas they are incorporated into a light emitting and receiving unit 430 and placed on one side of the sheet transport path 401 in the present embodiment. The reflecting member 440 is disposed on the other side of the sheet transport path 401. Accordingly, the transported sheet detecting device 482 of the second embodiment is provided with the light emitting and receiving unit 430 and the reflecting member 440. The sheet is transported in the direction from a front side to a back side of the drawing sheet of FIGS. 13A and 13B, and from a right hand to a left hand of the drawing sheet of FIG. 13C.

The light emitting and receiving unit 430 is comprised of the light emitting element 411, the light receiving element 421, the printed circuit board (mount member) 432 on which the light emitting element 411 and the light receiving element 421 are mounted, and the case member (tip preventing member) 444. The case member 444 is provided with a slit 413 for restricting the light emitted from the light emitting element 411 to provide the light with directivity, a slit 423 for restricting the light received by the light receiving element 421 to provide the light with directivity, a shield wall 437 for preventing light except for the light emitted from the light emitting element 411 and reflected by the reflecting member 440, from being detected by the light receiving element 421, a guide hole 416*a* in which the light emitting element 411 is set, and a guide hole 426*a* in which the light receiving element 421 is set.

The guide hole 416*a* serves to prevent the light emitting element 411 from tipping in the directions indicated by the double-headed arrow B in FIGS. 13A and 13B. The guide hole 426*a* serves to prevent the light receiving element 421 from tipping in the directions indicated by the double-headed arrow B in FIGS. 13A and 13B.

The reflecting member 440 is constructed of a prism of glass or acrylic resin having reflective planes 442, 443 angled at 90°. The reflecting member 440 is fitted in a through hole 427 of the sheet guide 403. The reflecting member 440 is configured to receive the incident light emitted from the light emitting element 411 and passed normally through the plane 441, reflect the light by internal reflection at or above the critical angle on the reflective planes 442, 443, and again let the light pass normally through the plane 441. Namely, the reflecting member is arranged so that the incident light and the reflected light become parallel to each other. The reflecting member 440 does not have to be limited to the prism, but may be any member with a higher reflectance (an optically more reflective member) than the sheet S.

The operation of the transported sheet detecting device 482 of the second embodiment will be described below.

When no sheet S is transported yet to the detection position, as shown in FIG. 13A, the light L emitted from the light emitting element 411 travels through the slit 413 and the through holes 417, 427, is reflected by the reflective member 440, and then travels through the through holes 427, 417 and the slit 423 to reach the light receiving element 421. When a sheet S is transported up to the detection position, as shown in FIGS. 13B and 13C, the light L emitted from the light emitting element 411 is shut off by the sheet S and does not reach the light receiving element 421.

Accordingly, the transported sheet detecting device 482 of the second embodiment is configured to determine the absence of the sheet with detection of light at the light receiving element 421 and the presence of the sheet without detection of light.

Since in the transported sheet detecting device 482 of the present embodiment the electrode wires 414, 415, 424, 425 of the light emitting element 411 and the light receiving element 421 are arranged along the sheet transport direction, as shown in FIG. 13C, the light emitting element 411 and the light receiving element 421 are difficult to tip (or slant) in the directions indicated by the double-headed arrow A.

Accordingly, the transported sheet detecting device 482 of the present embodiment is also able to enhance the sheet detection accuracy as the transported sheet detecting device 481 of the first embodiment was.

Even if the light emitting element 411 and the light receiving element 421 should come to tip in the lateral directions (in the directions indicated by the double-headed arrow B) in the state in which the electrode wires appear one on a projection, the guide holes 416*a*, 426*a* of the case member 444 would prevent the tip.

Further, since the slits 413, 423 are formed in the common case member 444, the relative positional relation can be maintained accurate between the slits 413, 423, and the light from the light emitting element 411 can be transferred without waste to the light receiving element 421.

When a copying machine is equipped with the foregoing transported sheet detecting device 482 in the main body, it can accurately form an image on the transported sheet.

(Transported Sheet Detecting Device of Third Embodiment)

The transported sheet detecting device 483 of the third embodiment will be described on the basis of FIGS. 14A to 14C.

Figure 14A:
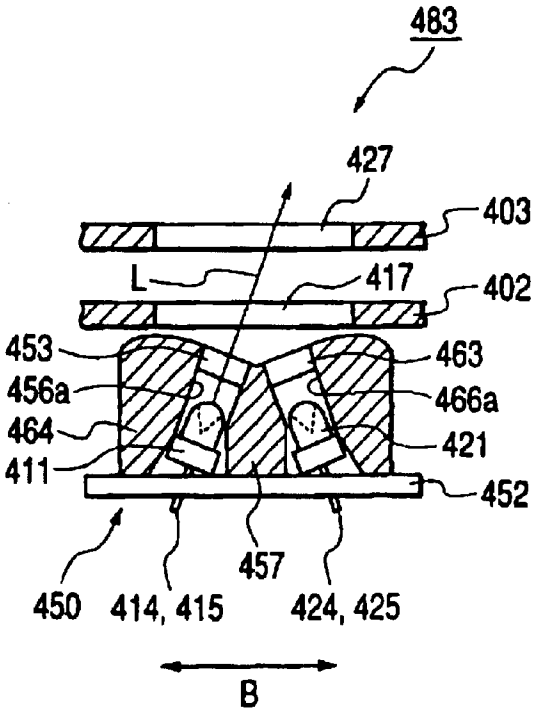

FIG. 14A is a sectional view along the direction intersecting with the sheet transport direction of the transported sheet detecting device 483. FIG. 14B is a sectional view along the direction intersecting with the sheet transport direction of the transported sheet detecting device 483, and is a view of a sheet detecting state. FIG. 14C is a sectional view along the sheet transport direction of the transported sheet detecting device 483, and is a view of a sheet detecting state.

In the transported sheet detecting device 483 of the third embodiment, the same portions as those in the transported sheet detecting device 481 of the first embodiment will be denoted by the same reference symbols and the description will be omitted in part.

Figure 14B:
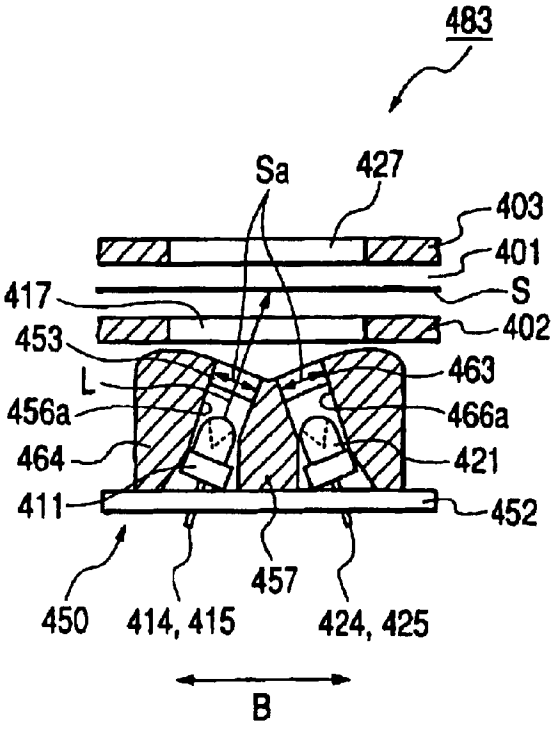
Figure 14C:
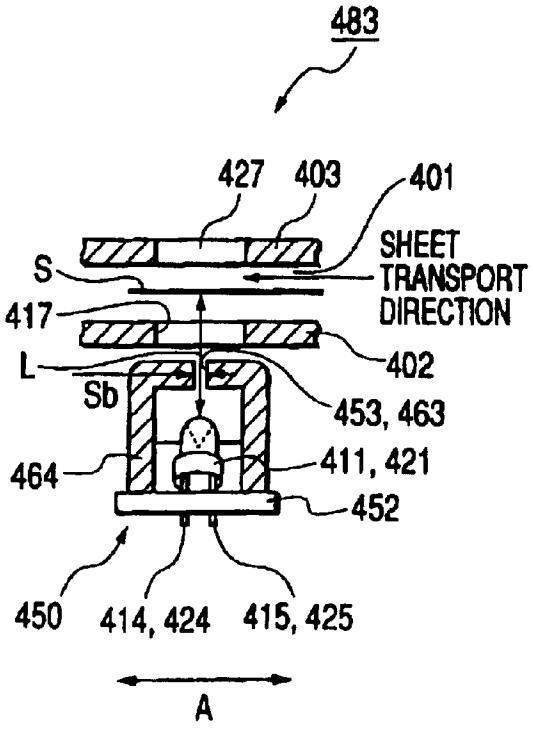
Figure 15:
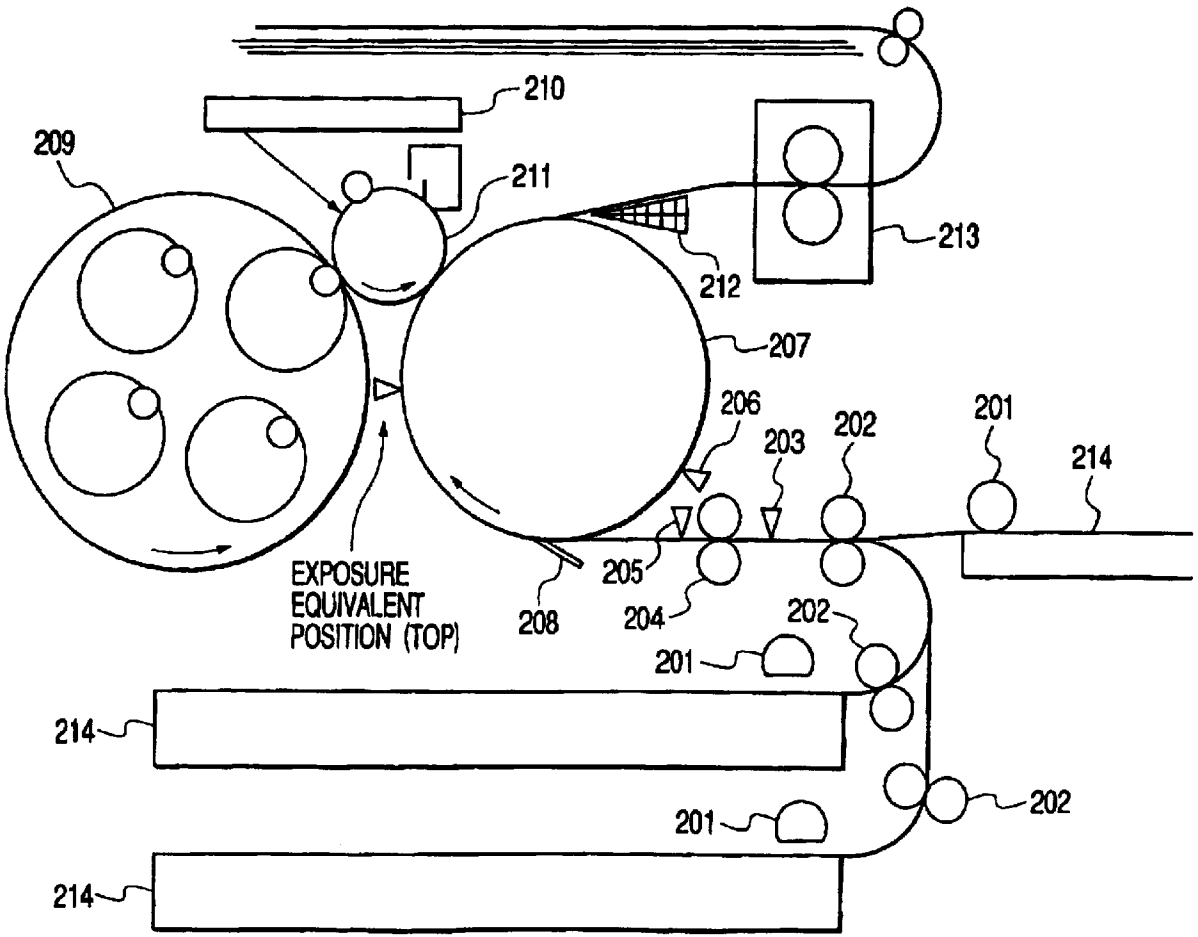
FIG. 15 RELATED ART
FIG. 15 is a schematic sectional view showing a configuration of an image forming apparatus.
Figure 16A:
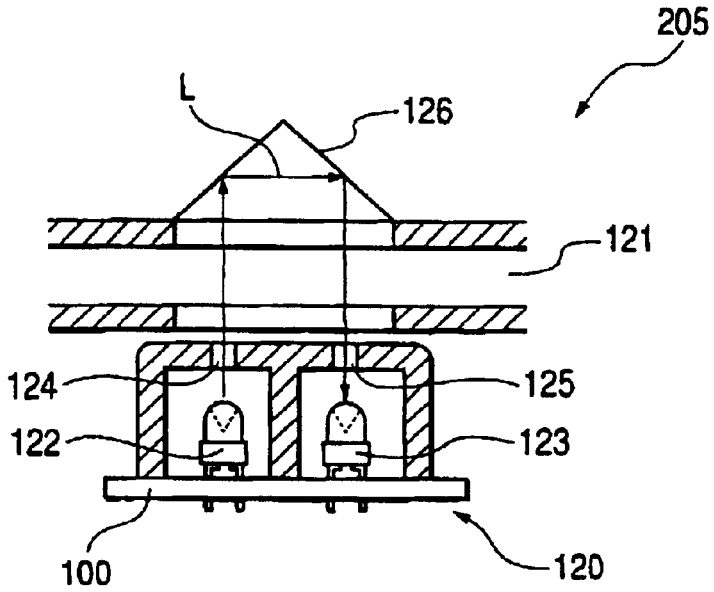
FIG. 16A RELATED ART
FIGS. 16A and 16B are schematic sectional views showing a configuration of a conventional sheet detecting device.
Figure 16B:
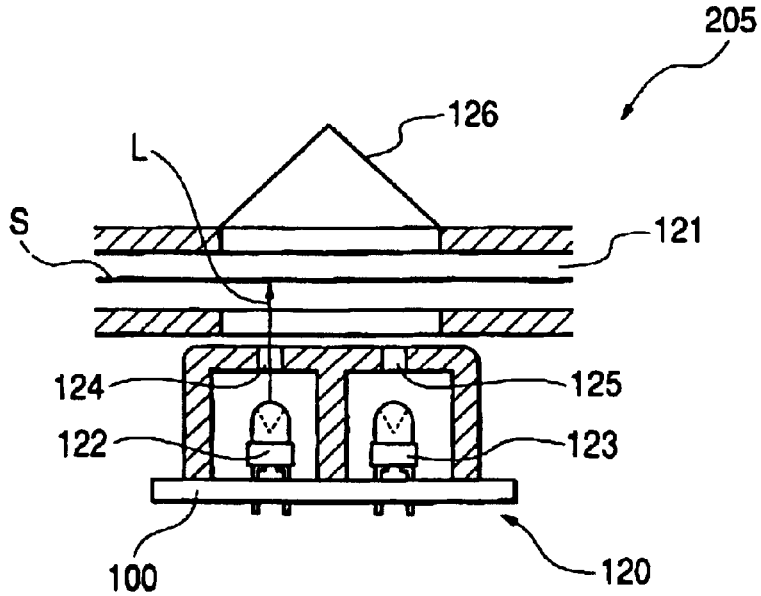
FIG. 16B RELATED ART
Figure 17A:
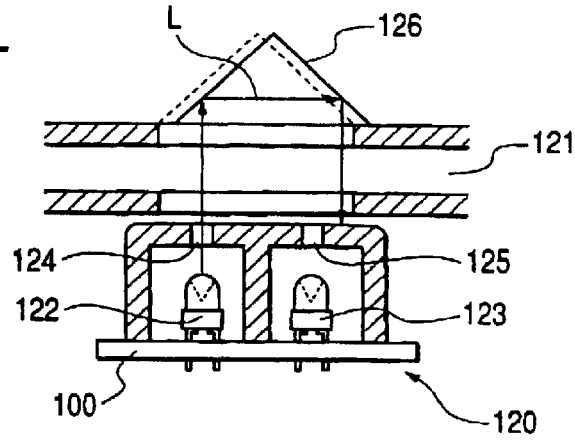
FIG. 17A RELATED ART
FIGS. 17A and 17B are illustrations to explain the influence of the relative positional deviation between the light emitting and receiving unit and the reflecting member on the optical path.
Figure 17B:
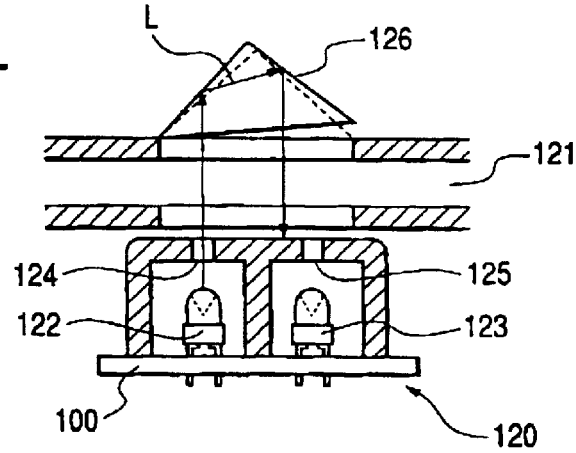
FIG. 17B RELATED ART
Figure 18:
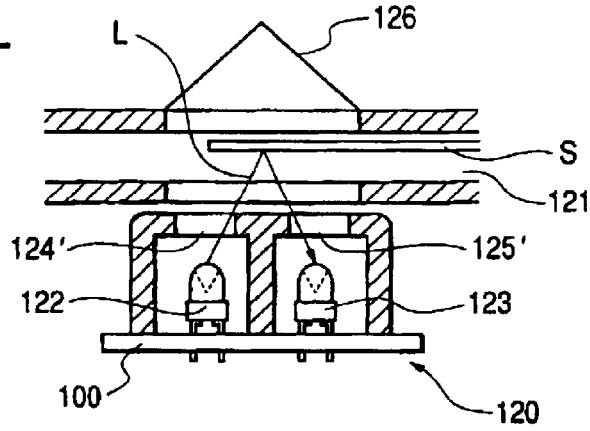
FIG. 18 RELATED ART
FIG. 18 is an illustration to explain the influence of the reflected light from the sheet surface.

FIGS. 14A, 14B, and 14C correspond to FIGS. 11A, 11B, and 11C, respectively. The transported sheet detecting device 483 of the third embodiment is constructed in a configuration in which the reflecting member 440 is eliminated from the transported sheet detecting device 482 of the second embodiment.

The transported sheet detecting device 483 of the third embodiment is provided with the light emitting and receiving unit 450 disposed on one side of the sheet transport path 401. The sheet is transported in the direction from a front side to a back side of the drawing sheet of FIGS. 14A and 14B and from a right hand to a left hand of the drawing sheet of FIG. 14C.

The light emitting and receiving unit 450 is comprised of the light emitting element 411, the light receiving element 421, the printed circuit board 452 on which the light emitting element 411 and the light receiving element 421 are mounted, and the case member (tip preventing member) 464. The case member 464 is provided with a slit 453 for restricting the light emitted from the light emitting element 411 to provide the light with directivity, a slit 463 for restricting the light received by the light receiving element 421 to provide the light with directivity, a shield wall 457 for preventing the light except for the light emitted from the light emitting element 411 and reflected by the sheet S, from being detecting by the light receiving element 421, a guide hole 456*a* in which the light emitting element 411 is set, and a guide hole 466*a* in which the light receiving element 421 is set.

The guide hole 456*a* serves to prevent the light emitting element 411 from tipping in the directions indicated by the double-headed arrows B in FIGS. 14A and 14B. The guide hole 466*a* serves to prevent the light receiving element 421 from tipping (or slanting) in the directions indicated by the double-headed arrow B in FIGS. 14A and 14B. The guide hole 456*a* and the guide hole 466*a* are inclined in mutually approaching directions so that the light L emitted from the light emitting element 411 can be reflected by the sheet S and received by the light receiving element 421.

The operation of the transported sheet detecting device 483 of the third embodiment will be described below.

When no sheet S is transported yet to the detection position, as shown in FIG. 14A, the light L emitted from the light emitting element 411 passes through the slit 453 and the through holes 417, 427, and does not reach the light receiving element 421. When a sheet S is transported up to the detection position, as shown in FIGS. 14B and 14C, the light L emitted from the light emitting element 411 is reflected by the sheet S to reach the light receiving element 421.

Accordingly, the transported sheet detecting device 483 of the third embodiment is configured to determine the absence of the sheet without detection of light at the light receiving element 421 and the presence of the sheet with detection of light.

Since in the transported sheet detecting device 483 of the present embodiment the electrode wires 414, 415, 424, 425 of the light emitting element 411 and the light receiving element 421 are arranged in the sheet transport direction, as shown in FIG. 14C, the light emitting element 411 and the light receiving element 421 are resistant to tipping in the directions indicated by the double-headed arrow A.

Therefore, the transported sheet detecting device 483 of the present embodiment is also able to enhance the sheet detection accuracy as the transported sheet detecting device 481 of the first embodiment was.

Even if the light emitting element 411 and the light receiving element 421 should come to tip in the lateral directions (in the directions indicated by the double-headed arrow B) in the state in which the electrode wires appear one on a projection, the guide holes 456*a*, 466*a* of the case member 464 would prevent the tip of the elements.

Further, since the slits 453, 463 are formed in the common case member 464, it is feasible to maintain the relative positional relation accurate between the slits 453, 463 and transmit the light without waste from the light emitting element 411 to the light receiving element 421.

When a copying machine is equipped with the foregoing transported sheet detecting device 483 in the main body, it is able to form an image on the transported sheet with accuracy.

The transported sheet detecting devices of the present invention have permitted the improvement in the detection position accuracy of the transported sheet, and the stable detection, regardless of the mounting position accuracy of the detecting means.

What is claimed is:

1. A sheet detecting device comprising:

a light emitting and receiving unit having a light emitting element for emitting detection light and a light receiving element for receiving the detection light;

a reflecting member for reflecting the detection light emitted from said light emitting element and making a reflected light incident to said light receiving element, wherein said light emitting and receiving unit and said reflecting member are disposed with a sheet transport path interposed therebetween, wherein said sheet detecting device is configured to detect a sheet on the basis of interruption of the detection light by the sheet being transported on the sheet transport path;

an emission slit which restricts the detection light emitted from said light emitting element; and a reception slit which restricts the detection light incident to said light receiving element, wherein a width of said emission slit along a sheet transport direction is greater than a width of said emission slit along a direction intersecting with the sheet transport direction, and a width of said reception slit along the direction intersecting with the sheet transport direction is greater than a width of said reception slit along the sheet transport direction.

2. A sheet detecting device according to claim 1, wherein said light emitting element and said light receiving element are disposed so that center axes of respective optical paths thereof become approximately parallel to each other, and wherein said reflecting member reflects the detection light incident approximately normally from said light emitting element, approximately in parallel with the detection light to make the reflected light incident approximately normally to said light receiving element.

3. A sheet detecting device according to claim 2, wherein said reflecting member is comprised of an optical prism.

4. A sheet detecting device according to claim 2, wherein the width of said reception slit along the direction intersecting with the sheet transport direction is approximately two or more times greater than the width of said emission slit along the direction intersecting with the sheet transport direction.

5. A sheet detecting device according to claim 1, wherein an area of said emission slit is greater than an area of said reception slit.

* * * * *